US010786133B2

(12) United States Patent
Jang et al.

(10) Patent No.: US 10,786,133 B2
(45) Date of Patent: Sep. 29, 2020

(54) ROBOT CLEANER

(71) Applicant: LG ELECTRONICS INC., Seoul (KR)

(72) Inventors: Jaewon Jang, Seoul (KR); Jeongseop Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 323 days.

(21) Appl. No.: 15/878,983

(22) Filed: Jan. 24, 2018

(65) Prior Publication Data

US 2018/0206691 A1 Jul. 26, 2018

(30) Foreign Application Priority Data

Jan. 25, 2017 (KR) ..... 10-2017-0012265

(51) Int. Cl.

| | |
|---|---|
| ***A47L 11/16*** | (2006.01) |
| ***A47L 11/292*** | (2006.01) |
| ***A47L 11/40*** | (2006.01) |

(52) U.S. Cl.

CPC ..... *A47L 11/4083* (2013.01); *A47L 11/161* (2013.01); *A47L 11/292* (2013.01); *A47L 11/4011* (2013.01); *A47L 11/4038* (2013.01); *A47L 11/4061* (2013.01); *A47L 11/4066* (2013.01); *A47L 2201/04* (2013.01); *A47L 2201/06* (2013.01)

(58) Field of Classification Search

CPC .. A47L 11/161; A47L 11/292; A47L 11/4011; A47L 11/4038; A47L 11/4061; A47L 11/4083; A47L 2201/04

See application file for complete search history.

(56) References Cited

U.S. PATENT DOCUMENTS

2013/0092190 A1* 4/2013 Yoon ..... G05D 1/0242 134/18
2014/0209122 A1* 7/2014 Jung ..... A47L 11/4011 134/18

FOREIGN PATENT DOCUMENTS

| | | |
|---|---|---|
| EP | 2 875 768 A1 * | 5/2015 |
| KR | 10-2008-0091042 | 10/2008 |
| KR | 10-2015-0060030 | 6/2015 |
| KR | 10-1613446 | 4/2016 |

OTHER PUBLICATIONS

Korean Office Action dated Aug. 20, 2018 issued in Application No. 10-2017-0012265.

* cited by examiner

*Primary Examiner* — Randall E Chin
(74) *Attorney, Agent, or Firm* — KED & Associates, LLP

(57) ABSTRACT

The disclosure relates to a robot cleaner. The robot cleaner comprises a main body; a plurality of spin mop assemblies disposed at a lower portion of the main body and configured to include at least one mop pad attached at lower portions of the plurality of spin mop assemblies; a driving assembly configured to drive the plurality of spin mop assemblies; a first supply assembly configured to store a first liquid inside the main body and supply the first liquid to at least one mop pad of some of the plurality of spin mop assemblies by adjusting a first valve; and a second supply assembly configured to store a second liquid inside the main body and supply the second liquid to at least one mop pad of the others of the plurality of spin mop assemblies by adjusting a second valve.

17 Claims, 22 Drawing Sheets

ROBOT CLEANER

CROSS-REFERENCE TO RELATED APPLICATION

This application claims the priority benefit of Korean Patent Application No. 10-2017-0012265, filed on Jan. 25, 2017 in the Korean Intellectual Property Office, the disclosure of which is incorporated herein by reference.

BACKGROUND OF THE INVENTION

1. Field of the Invention

The present invention relates to a robot cleaner, more particularly to a robot cleaner adapted to drive a spin mop.

2. Description of the Related Art

In recent years, the use of robots at home has increased gradually. An exemplary home robot is a cleaning robot. The cleaning robot, as a robot cleaner, moves without human control, and provides autonomous cleaning operations by sucking foreign substances such as dust accumulated on a floor. The cleaning robot can not only move, but also clean the floor simultaneously, by the operation of a spin mop.

An example of the robot cleaner for the simultaneous moving and cleaning operations, by the spin mop, is a robot cleaner including two spin mops, by which cleaning operations can be performed while moving.

However, the robot cleaner driven by two spin mops has the disadvantage of unstable moving thereof.

Moreover, in the case of the robot cleaner including two spin mops, there is another disadvantage that only a single type of cleaning operation is performed while moving.

SUMMARY OF THE INVENTION

It is an object of the invention to provide a robot cleaner capable of two types of cleaning operations on a floor at one time traveling when the robot cleaner moves for cleaning operations.

It is another object of the invention to provide a robot cleaner capable of more stable moving while moving by driving of spin mops.

In some embodiments, the above and other objects can be accomplished by the provision of a robot cleaner comprising a main body, a plurality of spin mop assemblies disposed at a lower portion of the main body and configured to include at least one mop pad attached at lower portions of the plurality of spin mop assemblies, a driving assembly configured to drive the plurality of spin mop assemblies, a first supply assembly configured to store a first liquid inside the main body and supply the first liquid to at least one mop pad of some of the plurality of spin mop assemblies by adjusting a first valve, and a second supply assembly configured to store a second liquid inside the main body and supply the second liquid to at least one mop pad of the others of the plurality of spin mop assemblies by adjusting a second valve. Thus, each or some of the plurality of spin mop assemblies may be utilized as a different usage from the others, by dividing the plurality of spin mop assemblies into several groups.

In some embodiments, the first liquid and the second liquid may be water or cleaning liquid respectively, and thus some of the plurality of spin mop assemblies may be used for a cleansing operation and the others of the plurality of spin mop assemblies may be used for a wet cleaning operation.

In some embodiments, there are provided a plurality of spin mop assemblies comprising a first direction spin mop assembly disposed at a front portion of the main body, to which a first supply assembly may supply a first liquid, and a second direction spin mop assembly disposed at a back portion of the main body, to which a second supply assembly may supply a second liquid. Thus, the plurality of spin mop assemblies can be utilized as various usages.

In some embodiments, there are provided a plurality of spin mop assemblies comprising a third direction spin mop assembly disposed at a left portion of the main body, and a fourth direction spin mop assembly disposed at a right portion of the main body. In some embodiments, at least four spin mop assemblies can provide more stable moving to a robot cleaner.

In some embodiments, there is provided a robot cleaner including a dry-cleaning mode in which a plurality of spin mop assemblies are driven in a dry status, a wet-cleaning mode in which some of the plurality of spin mop assemblies are supplied water and the others of the plurality of spin mop assemblies are driven in a dry status, a cleansing mode in which some of the plurality of spin mop assemblies are supplied water and the others of the plurality of spin mop assemblies are supplied a cleaning liquid, and a controller configured to control the plurality of spin mop assemblies and a first and second valves, according to a mode of operation. Thus, according to a mode of operation, water or the cleaning liquid can be supplied to the spin mop assemblies and a moving direction of the robot cleaner can be controlled.

In accordance with the disclosure, the robot cleaner can selectively supply water or a cleaning liquid to a plurality of spin mop assemblies respectively, and thus the robot cleaner has the advantage of providing at least two types of cleaning operations at one time traveling.

In accordance with the disclosure, at least four spin mop assemblies are disposed at a low portion of the main body of the robot cleaner, and there is therefore the advantage of providing more stable moving.

In accordance with the disclosure, the robot cleaner has the advantage of providing cleaning operations suitable for a floor to be cleaned at one time traveling, by supplying water or a cleaning liquid to the spin mop assembly according to a mode of operation and controlling a moving direction.

BRIEF DESCRIPTION OF THE DRAWINGS

The above and other objects, features and other advantages of the embodiments will be more clearly understood from the following detailed description taken in conjunction with the accompanying drawings, in which.

DETAILED DESCRIPTION OF THE PREFERRED EMBODIMENTS

Advantages, features and demonstration methods of the disclosure will be clarified through various embodiments described in more detail below with reference to the accompanying drawings.

The disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present invention is only defined by scopes of claims. Wherever possible, the same reference numbers will be used throughout the specification to refer to the same or like parts.

Hereinafter, a robot cleaner according to some embodiments will be described with reference to the accompanying drawings. In the following description, the terminology "front" refers to the primary direction of motion of the robot cleaner 10.

Figure 1:
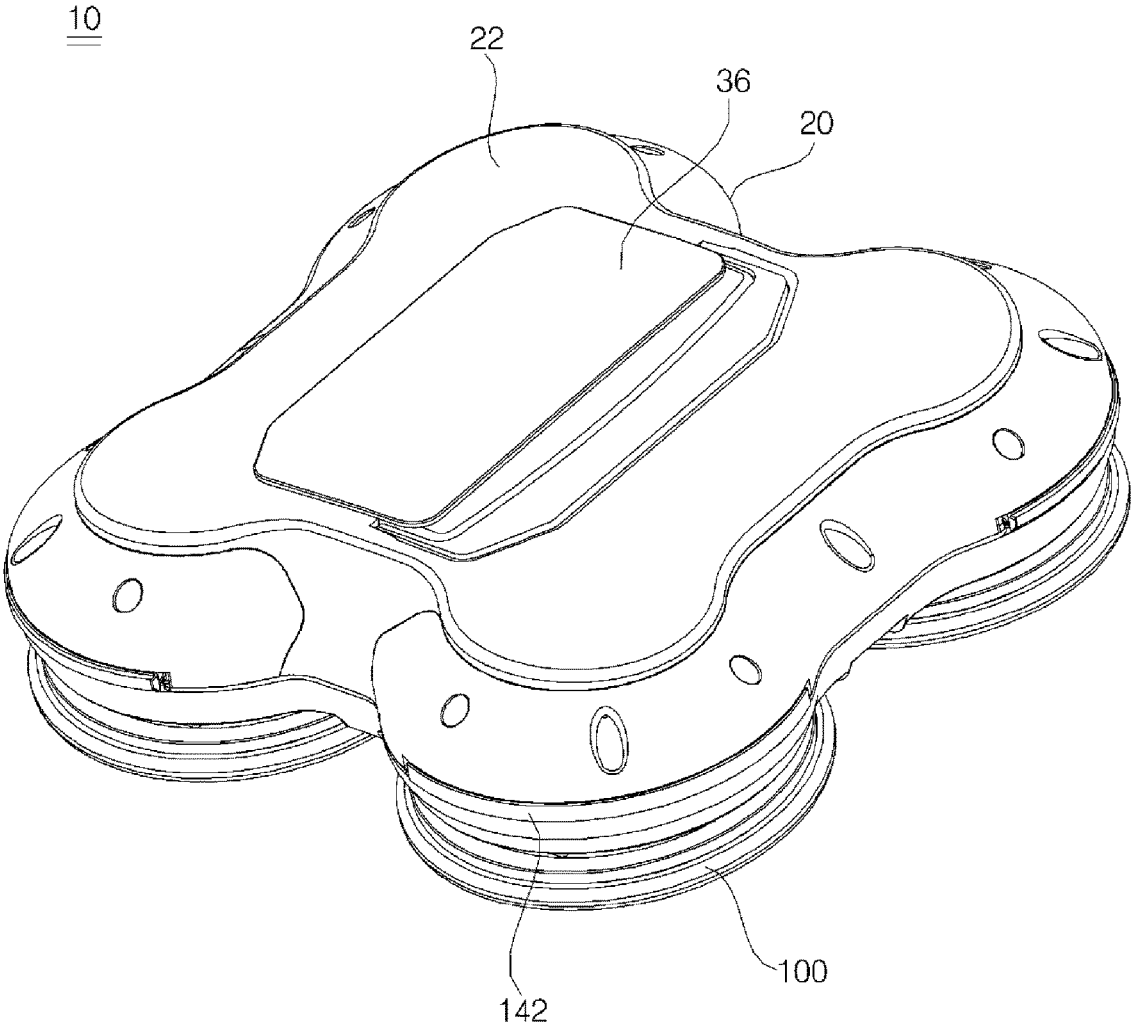
FIG. 1 is a perspective view illustrating a robot cleaner according to some embodiments.
Figure 2:
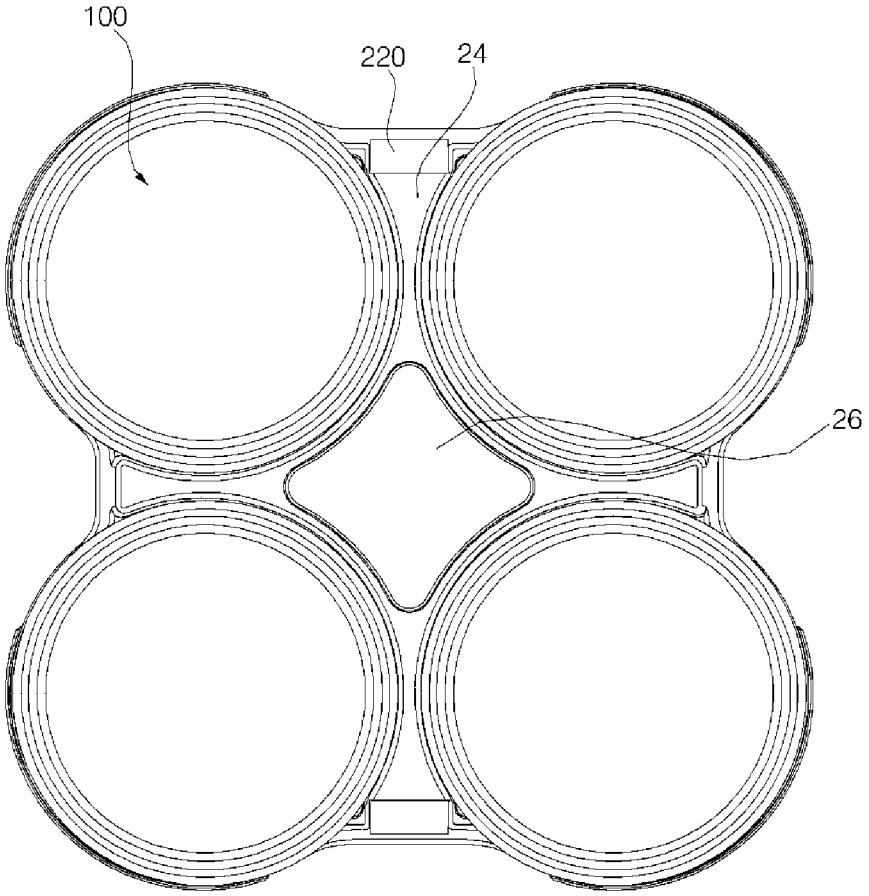
FIG. 2 is a bottom view illustrating the robot cleaner according to some embodiments.
Figure 3:
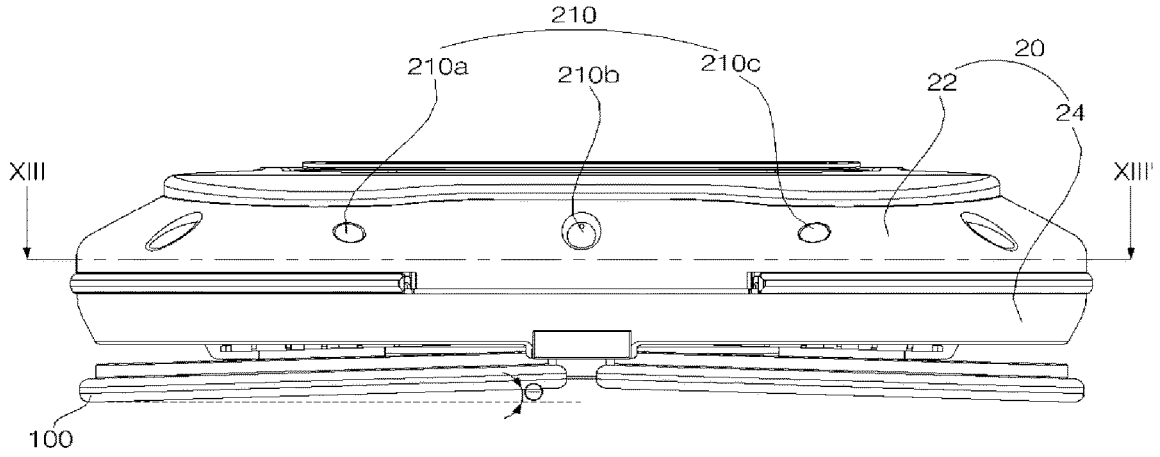
FIG. 3 is a front view illustrating the robot cleaner according to some embodiments.

FIG. 1 is a perspective view illustrating a robot cleaner according to some embodiments. FIG. 2 is a bottom view illustrating the robot cleaner according to some embodiments. FIG. 3 is a front view illustrating the robot cleaner according to some embodiments.

Hereinafter, a main body of a robot cleaner and elements disposed on the inside and outside of the main body are described with reference to FIGS. 1 to 3.

In accordance with some embodiments, a robot cleaner 10 comprises a main body 20, a plurality of spin mop assemblies 100*a*, 100*b*, 100*c*, 100*d* disposed at a lower portion of the main body and each configured to include mop pad attached at lower portions of each of the plurality of spin mop assemblies, at least one driving assembly 130 configured to drive the plurality of spin mop assemblies, a first supply assembly configured to store water inside the main body and supply the stored water to the mop pad of some of the plurality of spin mop assemblies by adjusting a first valve, and a second supply assembly configured to store a second liquid in the main body, and supply the second liquid to the mop pad of the others of the plurality of spin mop assemblies by opening or closing a second valve. In accordance with some embodiments, the robot cleaner 10 may further comprise at least one bumper assembly 140 disposed on a portion of an enclosure of the main body 20, and configured to detect or reduce an external impact generated on the main body 20.

The robot cleaner 10, which has an outer surface, comprises the main body 20 disposed at the upper portion of at least one spin mop assembly 100, a container 30 disposed inside the main body 20 and configured to store liquid which is supplied to the spin mop assembly 100, and a container cover 36 disposed at a portion of the container 30 and configured to open or close an upper portion of the container 30. The robot cleaner 10 may further comprise a spin mop guider 26 disposed at a lower portion of the main body 20 and configured to prevent interference among a plurality of spin mop assemblies.

The main body 20 comprises a top cover 22 forming an upper portion and an enclosure of the main body 20, and a base 24 forming a lower portion of the main body 20. The container 30 (see FIG. 13) configured to store a first liquid and a second liquid which are supplied to spin mop assemblies 100 and the container cover 36 configured to open or close the container 30 may be disposed inside the main body 20.

In accordance with some embodiments, the container 30 may comprise a first container 32 and a second container 34. The first container 32 may be configured to store a first liquid, and the second container 34 may be configured to store a second liquid. The first liquid may have the same properties as the second liquid, or different properties from the second liquid. In accordance with some embodiments, the first liquid may be water, and second liquid may be a cleaning liquid, which may be a liquid mixed with water and a detergent and cleanse dust or filth on the floor by chemical reactions. The detergent used with water may be in the form of a powder or a liquid.

Figure 13:
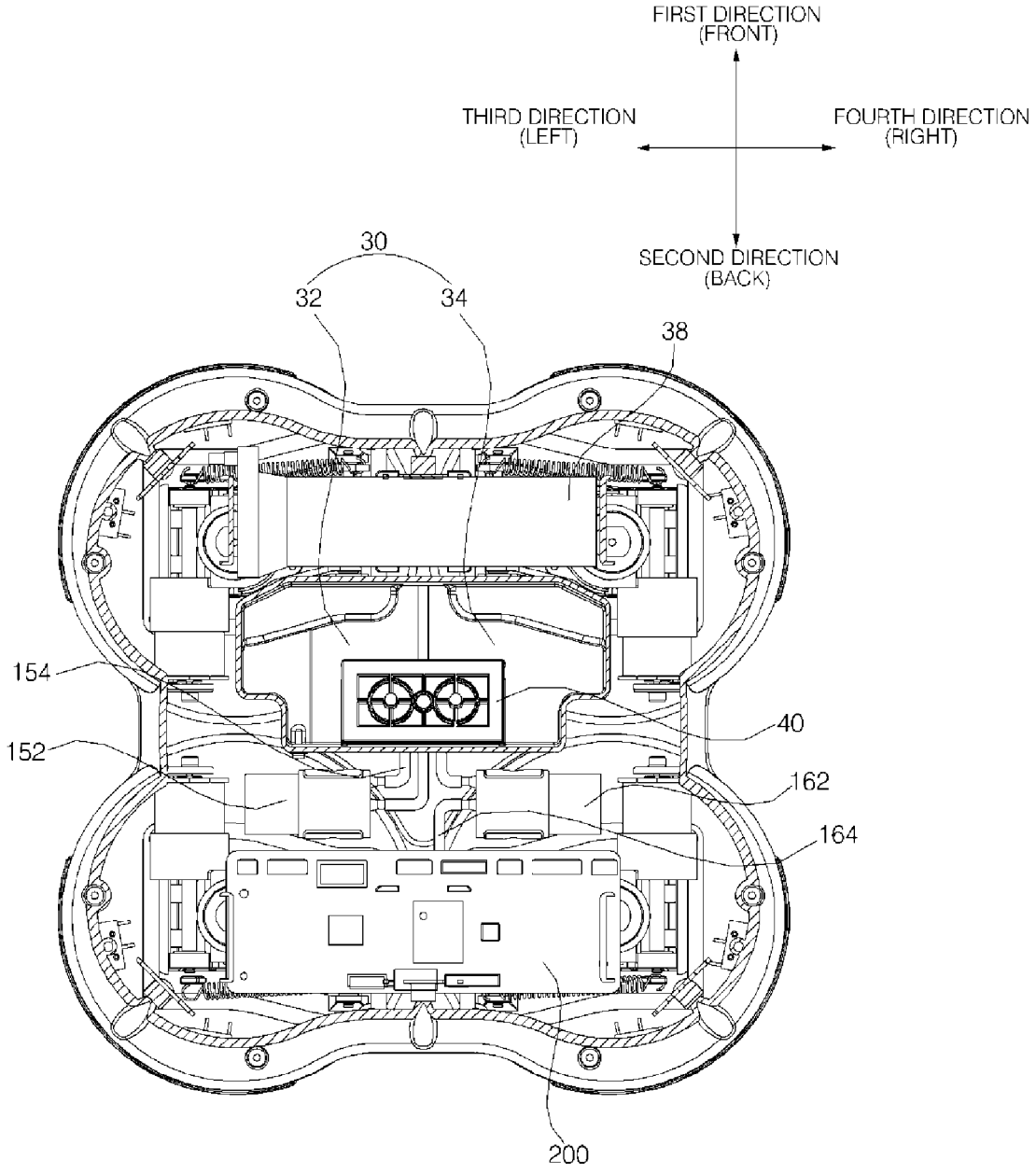
FIG. 13 is a cross-sectional view of the robot cleaner, horizontally taken along line XIII-XIII' of FIG. 3.

A sterilization module 40 for sterilizing some stored substances may be disposed inside the container 30, as illustrated in FIG. 13. The sterilization module 40 can sterilize a liquid stored in the container 30 and the inside thereof as well.

The spin mop guider 26 is disposed at the lower portion of the base 24, and can prevent interference among the plurality of spin mop assemblies 100. The spin mop guider 26 may be disposed at the center of one set of four spin mop assemblies 100. The spin mop guider 26 prevents enclosures of at least two spin mop assemblies 100 from touching each other.

Figure 4:
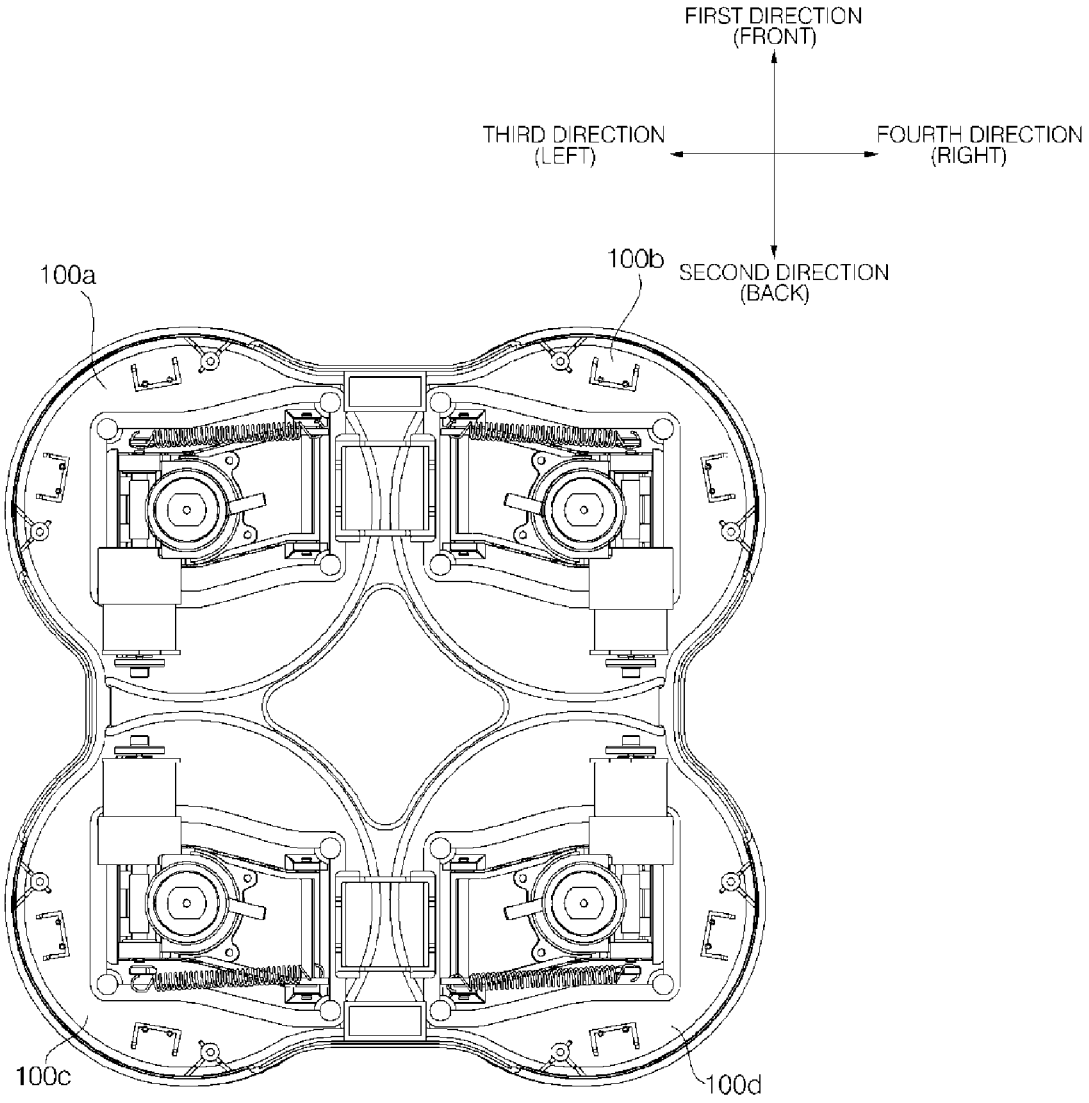
FIG. 4 is a view illustrating a plurality of spin mop assemblies of the robot cleaner according to some embodiments.
Figure 5:
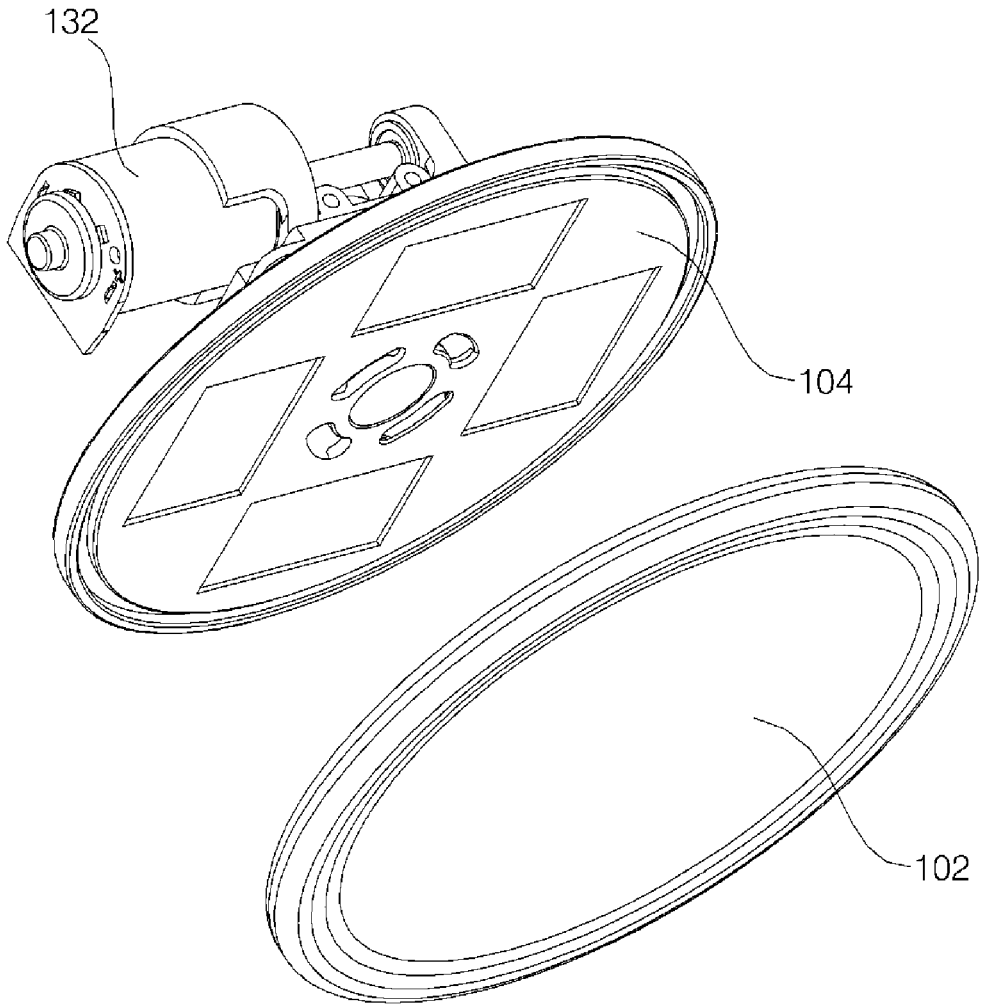
FIG. 5 is a view illustrating a rotary plate and a mop pad of a spin mop assembly of the robot cleaner according to some embodiments.
Figure 6:
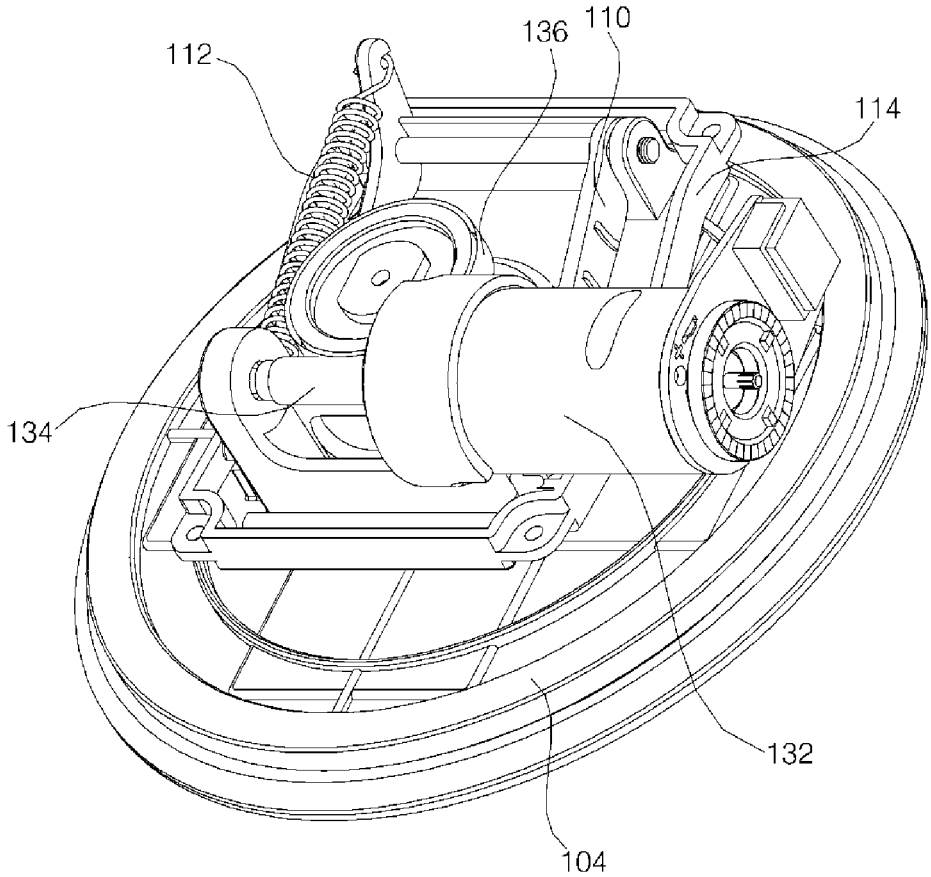
FIG. 6 is a perspective view illustrating the spin mop assembly and a driving assembly of the robot cleaner according to some embodiments.
Figure 7:
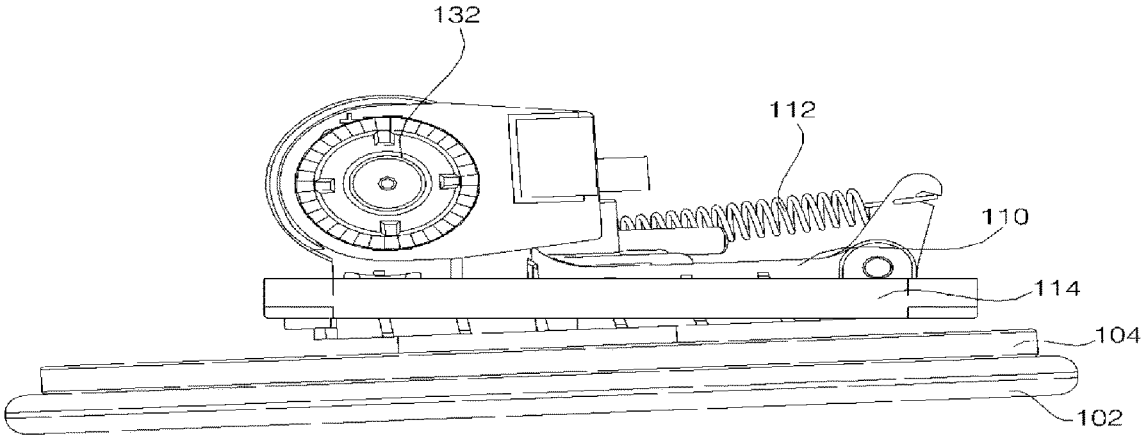
FIG. 7 is a side view illustrating the spin mop assembly and the driving assembly of the robot cleaner of FIG. 6 according to some embodiments.
Figure 8:
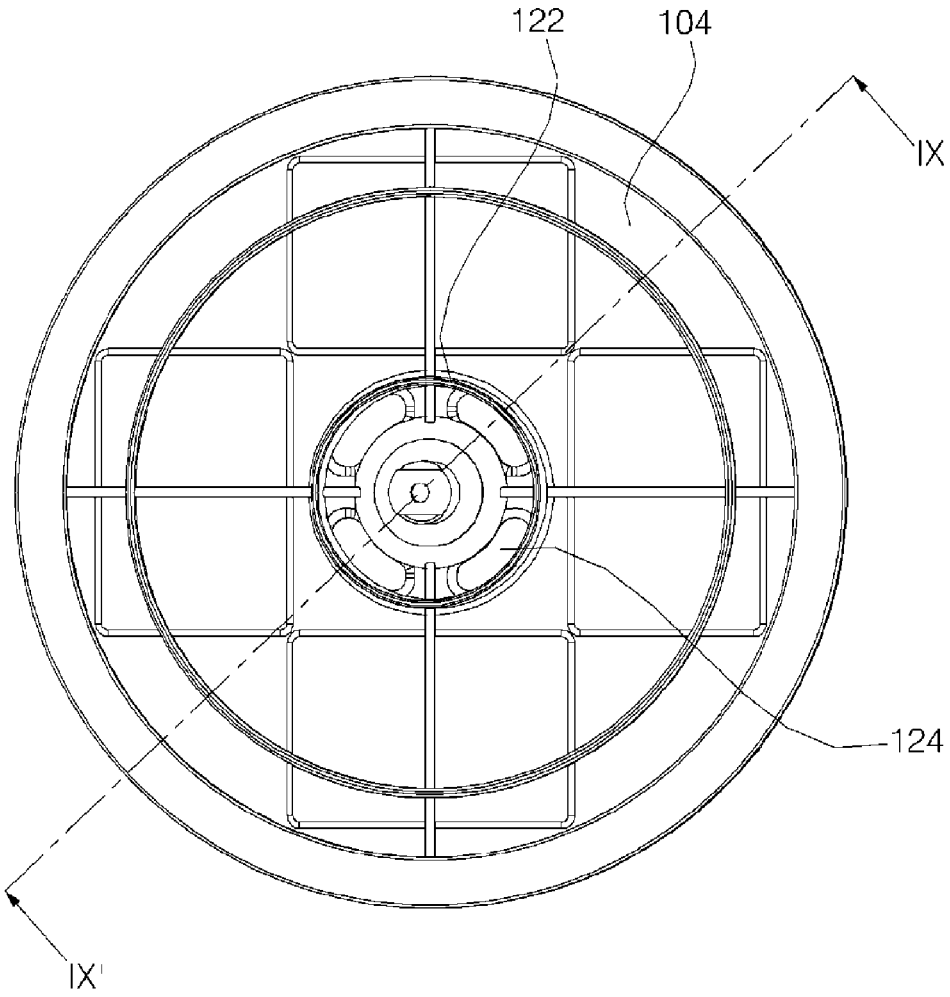
FIG. 8 is a view illustrating the rotary plate and a liquid collecting guider of the mop pad of the spin mop assembly according to some embodiments.
Figure 9:
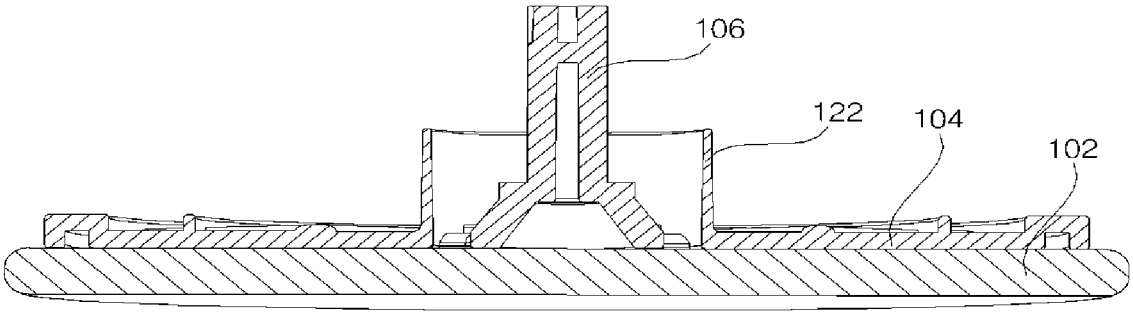
FIG. 9 is a cross-sectional view of the spin mop assembly, vertically taken along line IX-IX' in FIG. 8.
Figure 10:
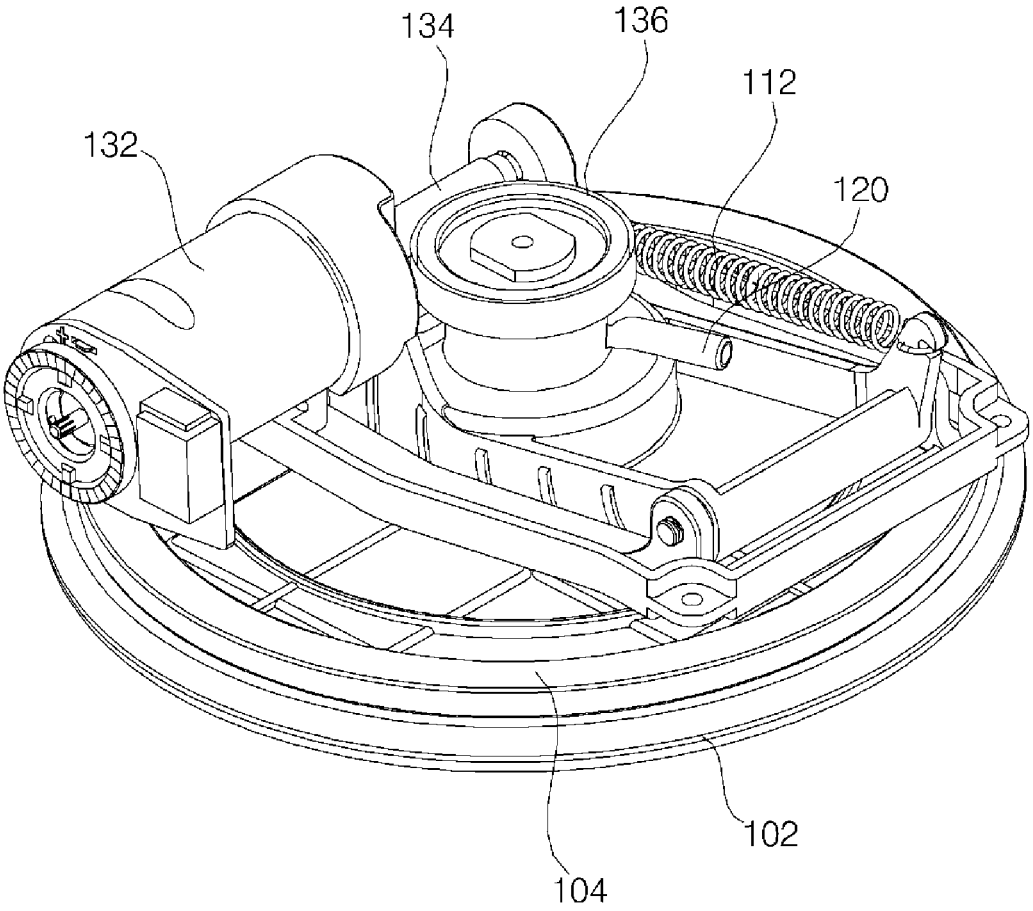
FIG. 10 is a perspective view illustrating the spin mop assembly and the driving assembly of the robot cleaner, as viewed from a different side in FIG. 6.

FIG. 4 is a view illustrating a plurality of spin mop assemblies of the robot cleaner according to some embodiments. FIG. 5 is a view illustrating a rotary plate and a mop pad of the spin mop assembly of the robot cleaner according to some embodiments. FIG. 6 is a perspective view illustrating the spin mop assembly and a driving assembly of the robot cleaner according to some embodiments. FIG. 7 is a side view illustrating the spin mop assembly and the driving assembly of the robot cleaner of FIG. 6 according to some embodiments. FIG. 8 is a view illustrating the rotary plate and a liquid collecting guider of the mop pad of the spin mop assembly according to some embodiments. FIG. 9 is a cross-sectional view of the spin mop assembly, vertically taken along line IX-IX' in FIG. 8. FIG. 10 is a perspective view illustrating the spin mop assembly and the driving assembly of the robot cleaner, as viewed from a different side in FIG. 6.

Hereinafter, referring to FIGS. 3 to 10, a spin mop assembly and a driving assembly are described according to some embodiments.

Referring to FIG. 4, the robot cleaner 10 according to some embodiments may move in a first direction or a second direction. The first direction is opposite to the second direction. In addition, the robot cleaner 10 may move in a third direction or a fourth direction. The third and fourth directions may be generally vertical to the first direction or the second direction respectively, and the third direction is opposite to the fourth direction. In the following description, the first, second, third, and fourth directions define the front, back, left and right directions of the robot cleaner respectively. It should be understood, however, that, although the terms first, second, etc. are used herein to describe directions, the scope of the invention should not be limited by these terms.

The robot cleaner 10 may include at least one spin mop assembly 100. The spin mop assembly 100 may be disposed at the lower portion of main body 20. The spin mop assembly 100 may be configured to cause the main body 20 to move and clean the floor by spinning thereof.

In accordance with some embodiments, the robot cleaner 10 may include a plurality of spin mop assemblies 100, but not limited to, a first spin mop assembly 100*a*, a second spin mop assembly 100*b*, a third spin mop assembly 100*c* and a fourth spin mop assembly 100*d*. The robot cleaner 10 may include five or more spin mop assemblies.

Referring to FIG. 4, the first, second, third, and fourth spin mop assemblies 100*a*, 100*b*, 100*c*, 100*d* are disposed at the front left, front right, back left, and back right portions of the robot cleaner 10 respectively. It should be understood, however, that, although the front left, the front right, etc. are used herein to describe locations, the scope of the invention should not be limited by these terms.

In accordance with some embodiments, the spin mop assembly 100 may include a first direction spin mop assembly disposed at the front of the lower portion of the main body 20, and a second direction spin mop assembly disposed on the back of the lower portion of the main body 20. The first direction spin mop assembly may include at least two spin mop assemblies, and hereinafter is defined to include one set of the first spin mop assembly 100*a* and the second spin mop assembly 100*b*. The second direction spin mop assembly may include at least two spin mop assemblies, and hereinafter is defined to include one set of the third spin mop assembly 100*c* and the fourth spin mop assembly 100*d*.

In alternative embodiments, the spin mop assembly 100 may include a third direction spin mop assembly disposed at the left of the lower portion of the main body 20, and a fourth direction spin mop assembly disposed at the right of the lower portion of the main body 20. The third direction spin mop assembly may include at least two spin mop assemblies, and hereinafter is defined to include one set of the first spin mop assembly 100*a* and the third spin mop assembly 100*c*. The fourth direction spin mop assembly may include at least two spin mop assemblies, and hereinafter is defined to include one set of the second spin mop assembly 100*b* and the fourth spin mop assembly 100*d*.

A first container 32 is connected to the first direction spin mop assembly 100*a*, 100*b*. Accordingly, a first liquid being stored in the first container 32 may be supplied to at least one mop pad 102 of the first direction spin mop assembly. A second container 34 is connected to the second direction spin mop assembly. Thus, a second liquid being stored in second container 34 may be supplied to at least one mop pad 102 of the second direction spin mop assembly.

In accordance with some embodiments, the first container of the robot cleaner may be connected to a first supply assembly, which will be described below, the second container may be connected to a second supply assembly. In accordance with some embodiments, the first liquid stored in the first container 32 may be water, and the second liquid in the second container 34 may be a cleaning liquid. In accordance with some embodiments, the first supply assembly 150 connected to the first direction spin mop assembly may be used as a liquid supply assembly, and a second supply assembly 160 connected to the second direction spin mop assembly may be used as a cleansing assembly. In alternative embodiments, both the first supply assembly 150 and the second supply assembly 160 may be used as the liquid supply assembly or the cleansing assembly.

In accordance with some embodiments, the first and third spin mop assemblies 100*a*, 100*c* of the third direction spin mop assembly may be driven at the same rotational direction and rotational speed. In accordance with some embodiments, FIG. 4 illustrates that the first and third spin mop assemblies 100*a*, 100*c* of the third direction spin mop assembly may be driven by separate driving motors 132. It should be noted, however, that the third direction spin mop assembly may be driven at the same rotational direction and rotational speed by a single driving motor 132.

The second and fourth spin mop assemblies 100*b*, 100*d* of the fourth direction spin mop assembly may be driven at the same rotational direction and rotational speed. In this case, as illustrated in FIG. 4, The second and fourth spin mop assemblies 100*b*, 100*d* of the fourth direction spin mop assembly may be driven by a single driving motor 132, or by separate driving motors 132.

Next, referring to FIGS. 5 to 10, a configuration of the spin mop assembly is described in detail. In accordance with some embodiments, the plurality of spin mop assemblies may include the same configuration or different configurations, but hereinafter, for convenience of description, description will be given in instances where the same configuration is applied to them. Therefore, the same reference number will be used to respective parts of the spin mop assemblies. That is, a reference number used on the spin mop assembly identifies respective parts of one or more spin mop assemblies.

The spin mop assembly 100 includes a rotary plate 104 which is connected to a driving assembly 130 and rotated by it, and a mop pad 102 attached to a lower portion of the rotary plate 104. The rotary plate 104 may include an attaching member by which the mop pad 102 can be attached to the rotary plate 104 or detached from it, and the attaching member may be made of an elastic fabric, such as Velcro-like material.

Referring to FIG. 7, the spin mop assembly 100 may be inclined relative to the floor at a predetermined angle. The spin mop assembly 100 may include a suspension base 110 which is connected to the rotary plate 104 and configured to adjust an inclination angle of the rotary plate 104, and an elastic member 112 which is configured to apply an elastic force to a portion of the suspension base 110 and adjust an inclination angle of the rotary plate 104. The suspension base 110 is connected by means of a hinge to a suspension frame 114 which is disposed on the base 24 of the main body 20. One portion of the elastic member 112 is connected on the suspension frame 114 and configured to apply an elastic force to the suspension base 110 to which another portion of the elastic member 112 is connected. In instances where a separate external force is not applied to the spin mop assembly 100, the rotary plate 104 of the spin mop assembly may be inclined relative to the floor at a predetermined angle by an elastic force of the elastic member 112, as illustrated in FIG. 7.

Referring to FIG. 3, an inclination angle of the third direction spin mop assembly relative to the floor, which is resulted from the elastic member 112 and the suspension base 110, may be generally symmetrical relative to an inclination angle of the fourth direction spin mop assembly relative to the floor.

The spin mop assembly 100 may include a nozzle 120, which is connected to a first hose 154 connected to the first container 32 or a second hose 164 connected to the second container 34, and a liquid collecting guider 122 for guiding or collecting some substances supplied from the nozzle 120. An upper part of rotary plate 104 may include a rotary plate hole 124 which is configured to supply the substances collected in the liquid collecting guider 122 to the mop pad 102.

A nozzle which is disposed on the first direction spin mop assembly is connected to the first hose 154, and supplies the first liquid stored in the first container 32, and another nozzle which is disposed on the second direction spin mop assembly is connected to the second hose 164, and supplies the second liquid stored in the second container 32.

The driving assembly 130 is configured to rotate the rotary plate 104 of the spin mop assembly 100. The driving assembly 130 may be disposed on each of the third direction spin mop assembly and the fourth direction spin mop assembly, or on each of four spin mop assemblies 100.

Next, referring to FIG. 10, the driving assembly 130 disposed on the spin mop assembly 100 is described.

The driving assembly 130 includes a driving motor 132 for providing a driving force to rotate the spin mop, a first gear 134 connected to a driving shaft 106 of the driving motor 132, and a second gear 136 which is engaged with the first gear 134 and configured to transfer the driving force to the rotary plate 104.

In accordance with some embodiments, the first gear 134 may be a worm gear for transferring the driving force to the second gear 136 to which the first gear 134 is generally vertically disposed relative. The second gear 136 which is engaged with the worm gear may receive the driving force from it.

The upper surface of rotary plate 104 includes a rotation shaft 106, which is protruded from the center toward upward, and the upper end of the rotation shaft 106 is connected to the second gear 136. The driving assembly 130 is disposed on an upper portion of the suspension base 110. Accordingly, even if an inclined angle of the rotary plate 104 is changed, the rotary plate 104 can be driven stably.

Figure 11:
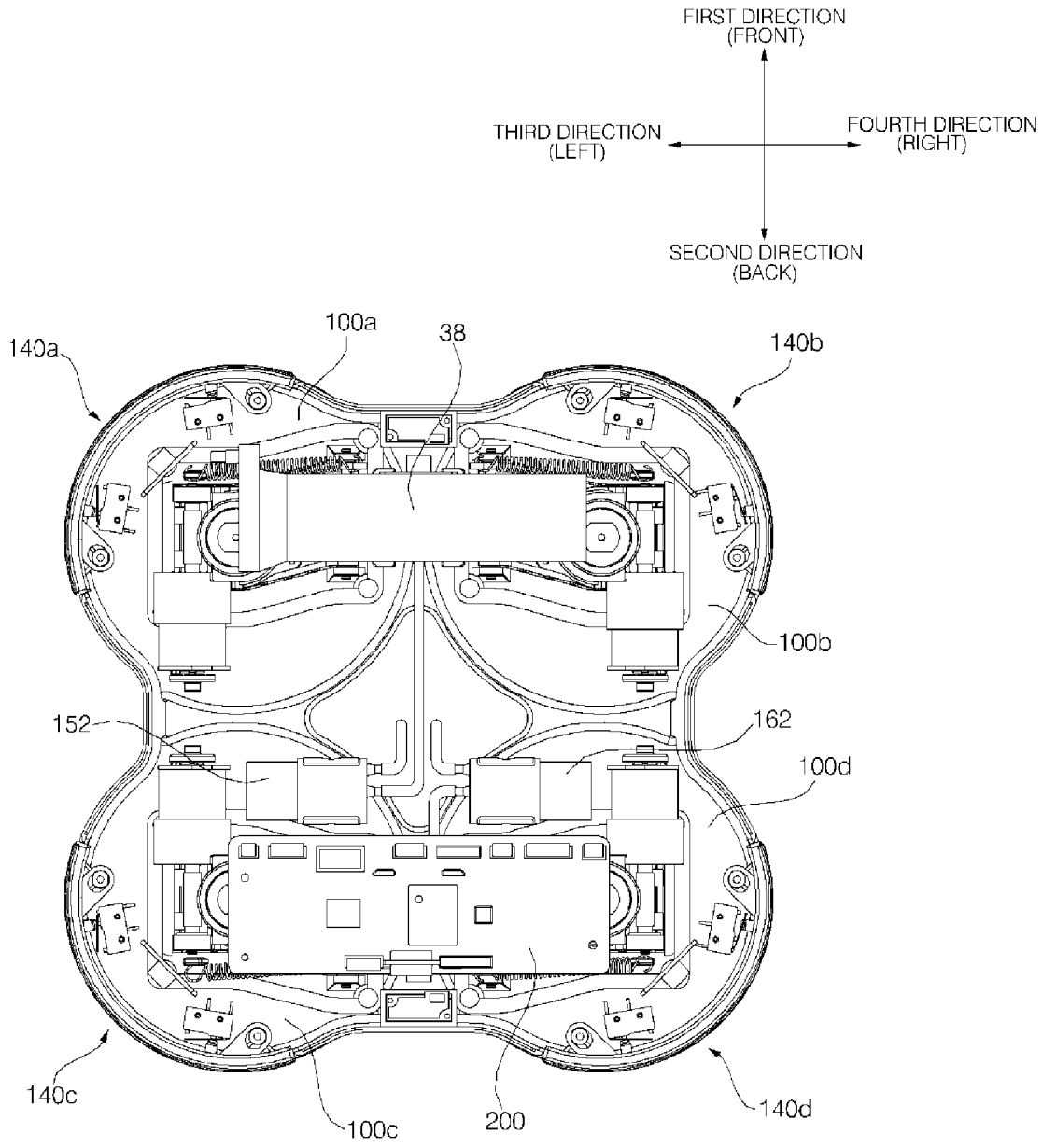
FIG. 11 is a view illustrating a configuration of a plurality of bumper assemblies according to some embodiments.
Figure 12:
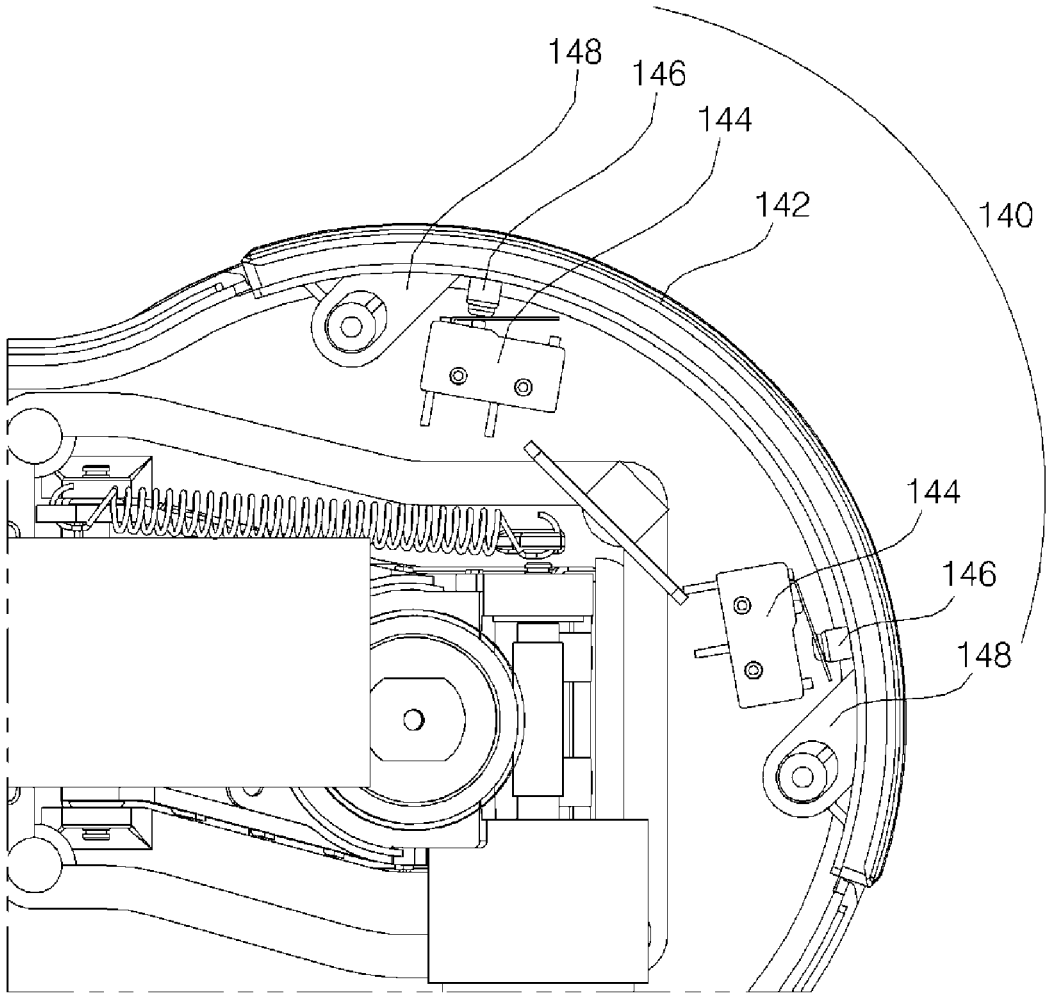
FIG. 12 is a view illustrating a configuration of a bumper assembly according to some embodiments.

FIG. 11 is a view illustrating a configuration of a plurality of bumper assemblies according to some embodiments. FIG. 12 is a view illustrating a configuration of a bumper assembly according to some embodiments.

Hereinafter, referring to FIGS. 11 to 12, the bumper assembly is described in accordance with some embodiments.

The bumper assembly 140 is disposed on an enclosure of the main body 20, such as a protruded or groove portion, an edge portion of the outer surface thereof. The bumper assembly 140 can detect an external impact which is generated while the robot cleaner 10 is moving, or reduce it. Referring to FIG. 11, the bumper assembly 140 according to some embodiments may be disposed on an enclosure of an upper portion of the spin mop assembly 100, such as a protruded or groove portion, an edge portion of the outer surface thereof.

In accordance with some embodiments, the robot cleaner 10 may include a plurality of bumper assemblies 140*a*, 140*b*, 140*c*, 140*d*. In accordance with some embodiments, the robot cleaner 10 may include a first bumper assembly 140*a*, a second bumper assembly 140*b*), a third bumper assembly 140*c*, and a fourth bumper assembly 140*d*. The number of the bumper assemblies is not limited to this. It is, therefore, possible that five or more bumper assemblies are employed.

Referring to FIG. 11, the first, second, third and fourth bumper assemblies 140*a*, 140*b*, 140*c*, 140*d* may be disposed on enclosures of the first, second, third, and fourth spin mop assemblies 100*a*, 100*b*, 100*c*, 1200*d* respectively.

Hereinafter, referring to FIG. 12, a configuration of the bumper assembly is described. In accordance with some embodiments, each of the plurality of bumper assemblies may include the same configuration, therefore the same reference number will be used to respective parts of the bumper assemblies. That is, a reference number used on the bumper assembly may identify respective parts of one or more bumper assemblies.

The bumper assembly 140 may include a bumper 142 which is disposed to be protruded on an enclosure of the main body 20, an impact detection sensor 144 which detects the movement of the bumper 142, and a pressure member 146 which puts pressure on the impact detection sensor 144 when the bumper 142 moves. The bumper assembly 140 may further include a movement guider member 148 which guides the movement of the bumper 142.

The bumper assembly 140 may include two impact detection sensors 144. Each of the bumper assemblies 140 may include impact detection sensors 144, which detect impact within a range of at least two directions which are generally vertical to each other.

In accordance with some embodiments, the robot cleaner 10 may apply at least two impact detection sensors 144 to each of the four bumper assemblies. Accordingly, it is possible that impacts generated not only in the first, second, third and fourth directions, but also in directions defined among the first, second, third or fourth directions are detected.

Figure 14:
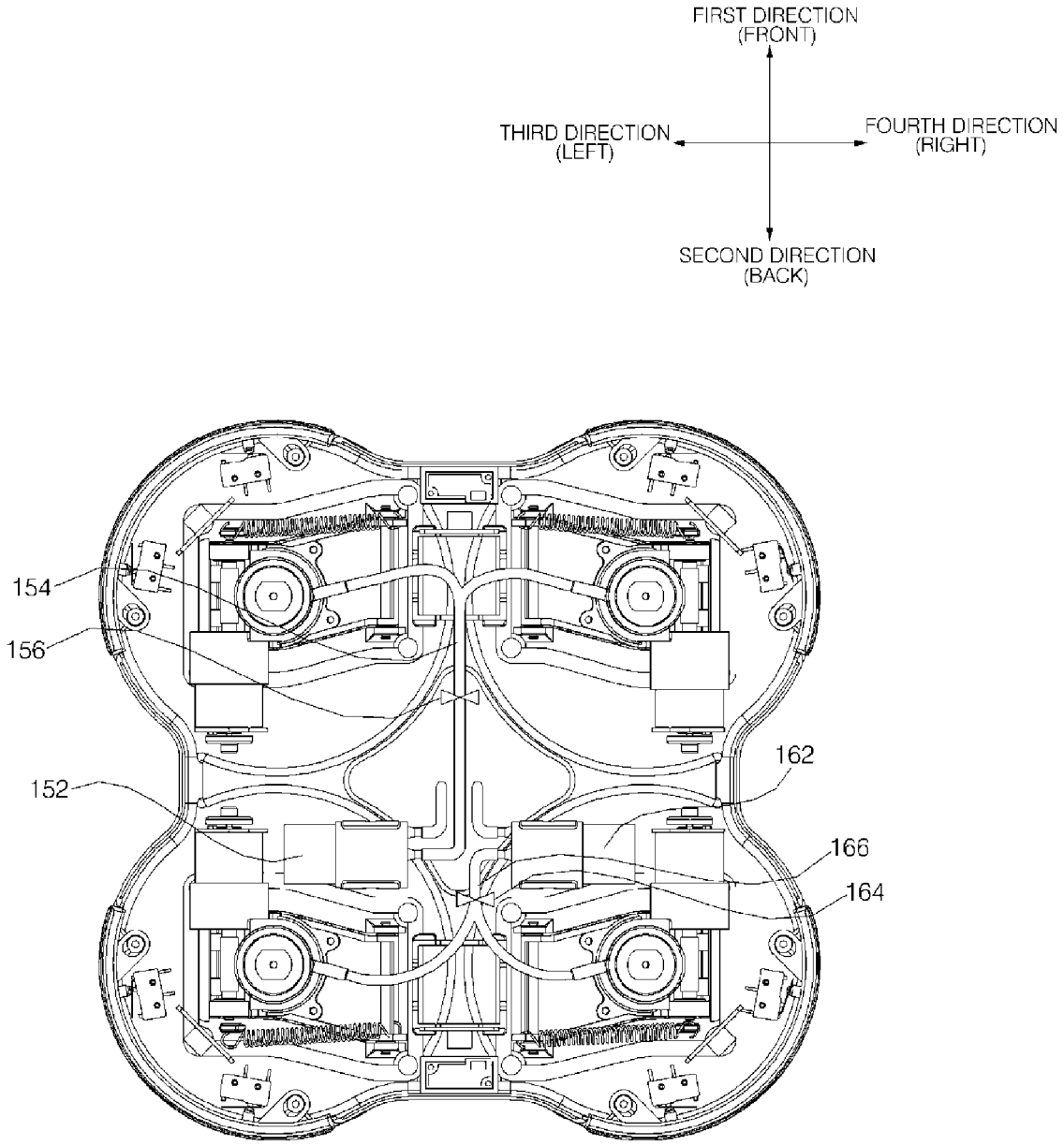
FIG. 14 is a view illustrating a configuration of a liquid supply assembly and a cleansing assembly according to some embodiments.

FIG. 13 is a cross-sectional view of the robot cleaner, horizontally taken along line XIII-XIII' of FIG. 3 FIG. 14 is a view illustrating a configuration of a fluid supply assembly and a cleansing assembly according to some embodiments.

Hereinafter, in accordance with some embodiments, a first supply assembly and a second supply assembly will be described with referring to FIGS. 13 to 14.

The robot cleaner 10 includes the first supply assembly 150 configured to supply the first liquid to the spin mop assembly 100 and the second supply assembly 160 configured to supply the second liquid to the spin mop assembly 100.

The first supply assembly 150 is configured to supply the first liquid to at least one mop pad of some of the plurality of spin mop assemblies 100*a*, 100*b*. In accordance with some embodiments, the first supply assembly 150 is configured to supply the first liquid to the first direction spin mop assembly.

The first supply assembly 150 includes a first container 32 configured to store the first liquid which is supplied to the spin mop assembly 100, a first pump 152 for supplying the first liquid stored in the first container 32 to the spin mop assembly 100, and a first hose 154 forming a channel for guiding the flow of the first liquid from the first container 32 to the spin mop assembly 100. The first supply assembly 150 may further include a first valve 156 which is disposed on the first hose 154 and configured to adjust the flow of the first liquid. The robot cleaner 10 can open or close the first valve 156 in accordance with a mode of operation for moving thereof.

In accordance with some embodiments, the first hose 154 is connected to a nozzle of the first direction spin mop assembly. The first hose 154 is configured to supply the first liquid to a liquid collecting guider of the first direction spin mop assembly.

The second supply assembly 160 is configured to supply the second liquid to at least one mop pad of the others of the plurality of spin mop assemblies 100*c*, 100*d*. In accordance with some embodiments, the second supply assembly 160 is configured to supply the second liquid to the second direction spin mop assembly.

The second supply assembly 160 includes a second container 34 configured to store the second liquid which is supplied to the spin mop assembly 100, a second pump 162 for supplying the second liquid stored in the second container 34 to the spin mop assembly 100, and a second hose 164 forming a channel for guiding the flow of the second liquid from the second container 34 to the spin mop assembly 100. The second supply assembly 160 may further include a second valve 166 which is disposed on the second hose 164 and configured to adjust the flow of the second liquid. The robot cleaner 10 can open or close the second valve 166 in accordance with a mode of operation for moving thereof.

In accordance with some embodiments, the second hose 164 is connected to the second direction spin mop assembly. The second hose 164 is configured to supply the second liquid to a liquid collecting guider of the second direction spin mop assembly.

In accordance with some embodiments, the first supply assembly 150 may be used as a liquid supply assembly 150 which uses water as the first liquid. In accordance with some embodiments, the second supply assembly 160 may be used as a cleansing assembly 160 which uses cleaning liquid as the second liquid.

The liquid supply assembly 150 is configured to supply water to the mop pad 102 of the spin mop assembly 100. In accordance with some embodiments, the liquid supply assembly 150 is configured to supply water to the first direction spin mop assembly.

The cleansing assembly 160 is configured to supply the cleaning liquid to the mop pad 102 of the spin mop assembly 100. The cleansing assembly 160 is configured to supply the cleaning liquid to the second direction spin mop assembly.

Referring FIG. 13, in accordance with some embodiments, the first container 32 of the first supply assembly 150 is disposed in a separate space from the second container 34 of the second supply assembly 160. It should be noted, however, that this is an example, and as an alternative embodiment, the first container 32 and the second container 34 may be integrated into one single container 30 in which the same liquid may be stored.

Figure 15:
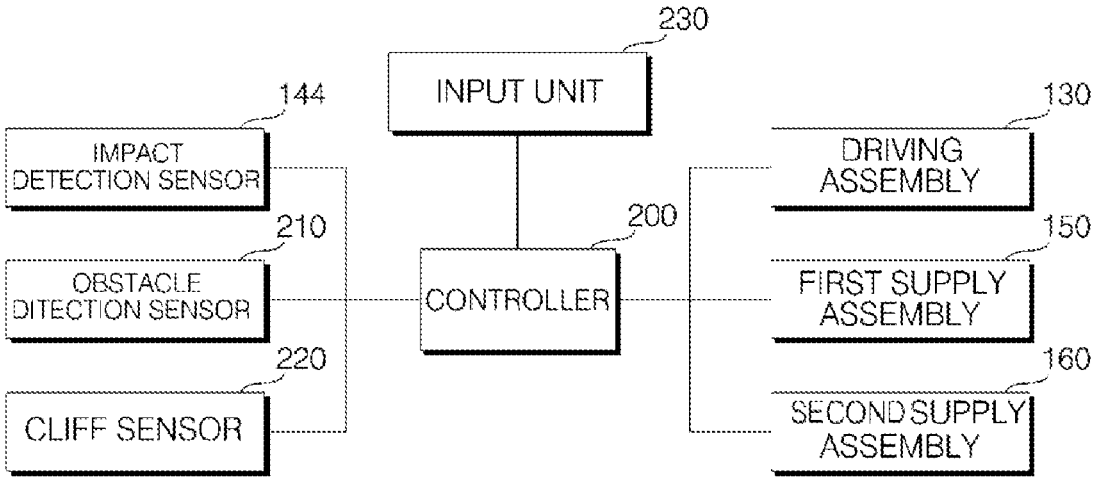
FIG. 15 is a block diagram illustrating a configuration in conjunction with a controller according to some embodiments.

FIG. 15 is a block diagram illustrating a configuration in conjunction with a controller according to some embodiments.

Hereinafter, in accordance with some embodiments, a sensor and a controller for driving the robot cleaner will be described with reference to FIG. 15.

In accordance with some embodiments, the robot cleaner 10 includes an obstacle detection sensor 210 configured to detect obstacles near the robot cleaner 10. The robot cleaner 10 may include a plurality of the obstacle detection sensor 210*a*, 210*b*, 210*c*, as illustrated in FIG. 3. In accordance with some embodiments, the obstacle detection sensor 210 of the robot cleaner 10 may be disposed on a front surface and a back surface of the main body 20. It should be noted, however, that this is an example, and as an alternative embodiment, the obstacle detection sensor 210 may be disposed on a side surface thereof.

In accordance with some embodiments, the robot cleaner 10 includes a cliff sensor 220 which detects whether a cliff is exist or not within an area to be cleaned. The robot cleaner 10 may be provided with a plurality of the cliff sensors 220. In accordance with some embodiments, the cliff sensor 220 may be disposed at a front portion and a back portion of the robot cleaner 10, as illustrated in FIG. 2.

In accordance with some embodiments, the robot cleaner 10 includes a controller 200 which controls operation of the robot cleaner 10. The controller 200 includes a printed circuit board disposed inside the main body 20. The controller 200 can process a signal from obstacle detection sensor 210 or the cliff sensor 220. The controller 200 can control the driving assembly 130 for moving of the robot cleaner 10. The controller 200 can cause the robot cleaner 10 to move forward or backward, or turn. The controller 200 can process a signal from the impact detection sensor 144 which detects an impact created by the bumper 142 while the robot cleaner 10 is moving. The controller 200 may control the driving assembly 130 based on a signal from the impact detection sensor 144 or the obstacle detection sensor 210.

The controller 200 may open or close the first valve 156 or the second valve 166, which are disposed on the first hose 154 or the second hose 164 respectively. The controller 200 may open or close the first valve 156 or the second valve 166 according to a mode of operation for moving of the robot cleaner 10.

In accordance with some embodiments, the robot cleaner 10 may include an input unit 230 for inputting a user's instruction. A mode of operation for moving of the robot cleaner 10 or the driving assembly 130 can be changed by an instruction through the input unit 230. The input unit 230 may be disposed on the robot cleaner 10, or on a mobile handset to which the robot cleaner 10 can communicate wirelessly or through a wired connection. The controller 200 may process some signals from the input unit 230 and control the robot cleaner 10.

In accordance with some embodiments, the robot cleaner 10 may further include a charger 38 for charging a battery for providing power with the robot cleaner 10. The charger 38 is configured to charge from external power source and supply the charged power to a driving motor 132 or a pump.

FIG. 16 is a view illustrating spinning of the plurality of spin mop assemblies when the robot cleaner makes a small radius turn according to some embodiments.

Hereinafter, referring to FIG. 16A to 16D, a description will be given of a rotational direction and a rotational speed of the spin mop assembly according to moving of the robot cleaner.

In accordance with some embodiments, each of the third direction spin mop assembly and the fourth direction spin mop assembly may be configured to enable the robot cleaner 10 to move. In instances where the robot cleaner 10 moves straight in the first or second direction, the third direction spin mop assembly and the fourth direction spin mop assembly have the same rotational speed, but rotational directions thereof are different to each other.

Figure 16A:
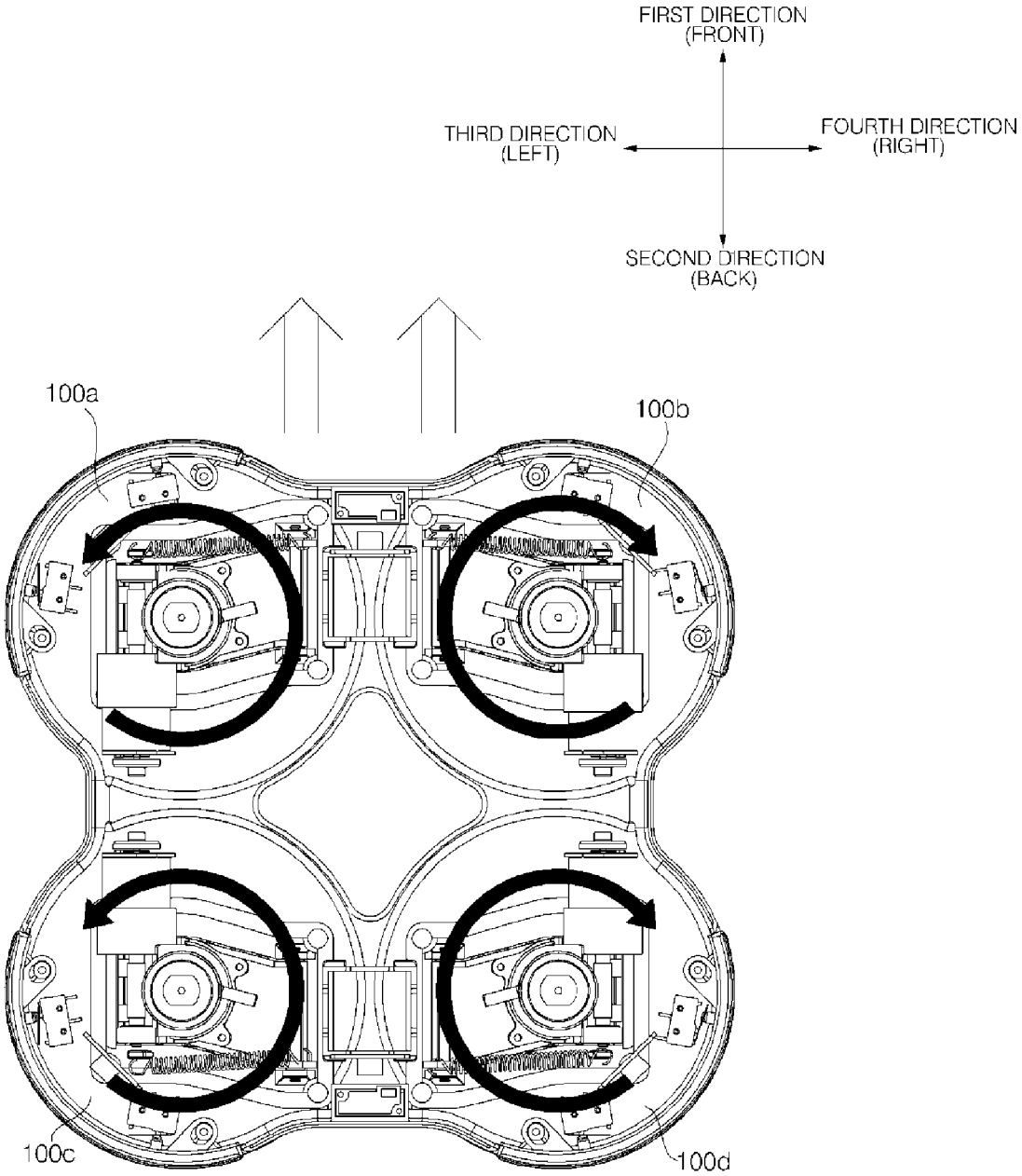
FIG. 16A is a view illustrating spinning of the plurality of spin mop assemblies when the robot cleaner moves straight in a first direction according to some embodiments.

Referring to FIG. 16A, in accordance with some embodiments, in instances where the robot cleaner 10 moves straight in the first direction, the third direction spin mop assembly may turn counterclockwise, and the fourth direction spin mop assembly may turn clockwise.

Figure 16B:
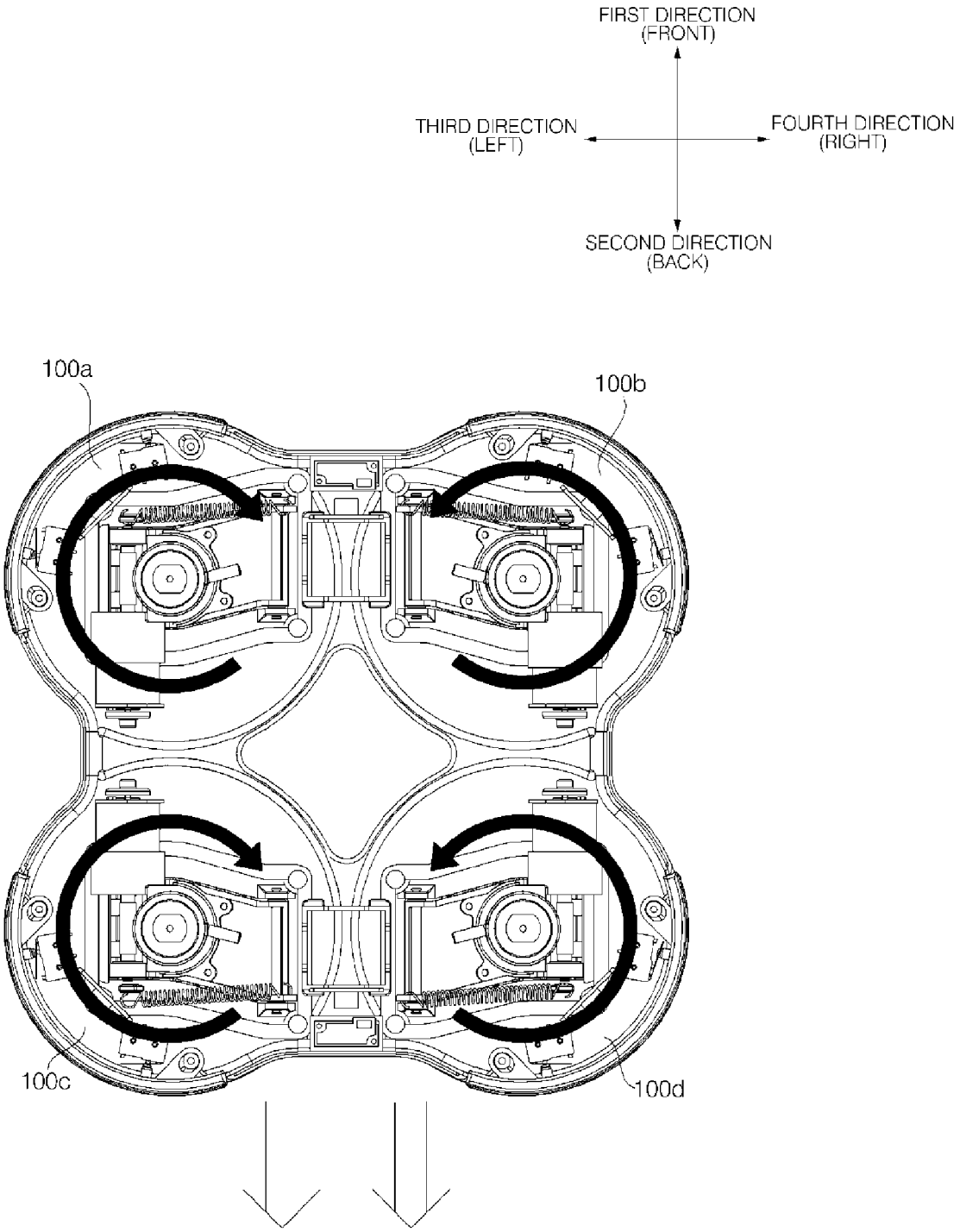
FIG. 16B is a view illustrating spinning of the plurality of spin mop assemblies when the robot cleaner moves straight in a second direction according to some embodiments.

Referring to FIG. 16B, in instances where the robot cleaner 10 moves straight in the second direction, the third direction spin mop assembly may turn clockwise, and the fourth direction spin mop assembly may turn counterclockwise.

In instances where the robot cleaner 10 turns, the third direction spin mop assembly and the fourth direction spin mop assembly have the same rotational direction or rotational speed, or it is possible that rotational speeds thereof are different to each other. The robot cleaner 10 may adjust a turning radius thereof by adjusting a difference between the rotational speeds of at least one spin mop of the third direction spin mop assembly and at least one spin mop of the fourth direction spin mop assembly.

Figure 16C:
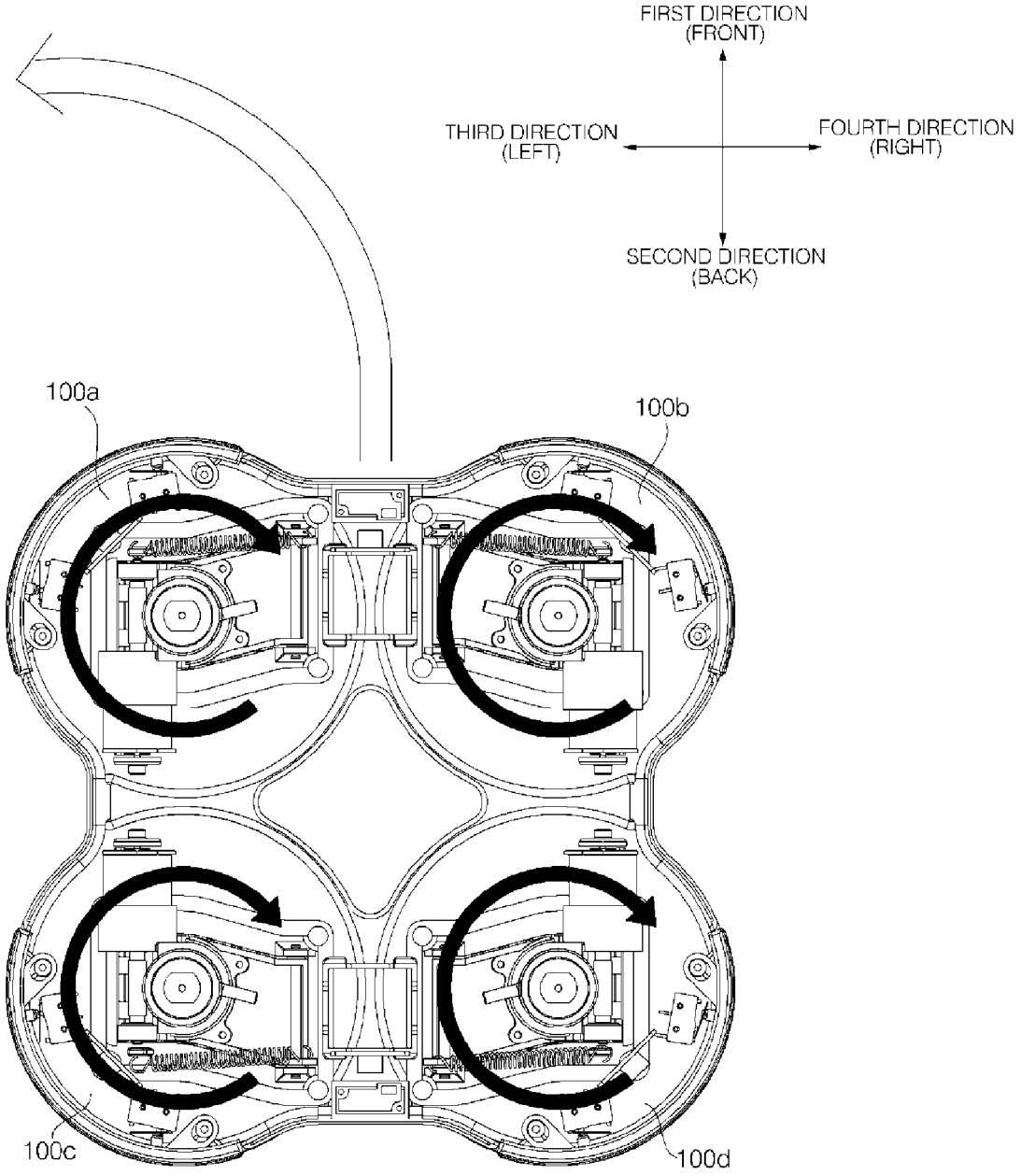
FIG. 16C is a view illustrating spinning of the plurality of spin mop assemblies when the robot cleaner makes a large radius turn according to some embodiments.
Figure 16D:
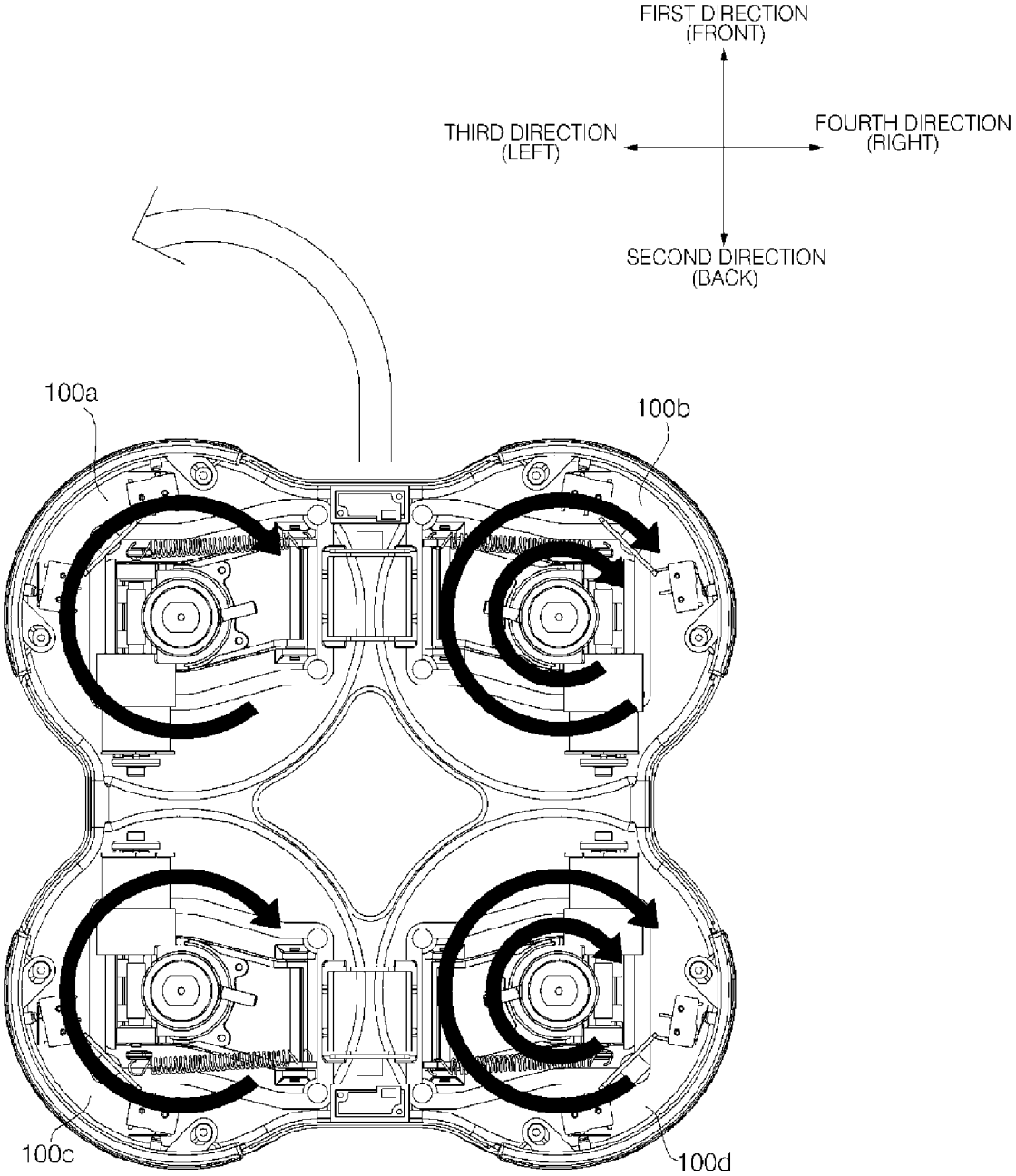
FIG. 16D is a view illustrating spinning of the plurality of spin mop assemblies when the robot cleaner makes a small radius turn according to some embodiments.

Referring to FIG. 16C, in instances where the robot cleaner 10 turns, and a rotational speed of a spin mop assembly, among the plurality of spin mop assemblies 100, that is located far from a turning radius of the robot cleaner 10 is faster than that of the others, a turning radius of the robot cleaner 10 becomes small. In addition, referring to FIG. 16D, in instances where the robot cleaner 10 turns, and a rotational speed of a spin mop assembly, among the plurality of spin mop assemblies 100, that is located far from a turning radius of the robot cleaner 10 is slower than that of the others, a turning radius of the robot cleaner 10 becomes large.

Figure 17:
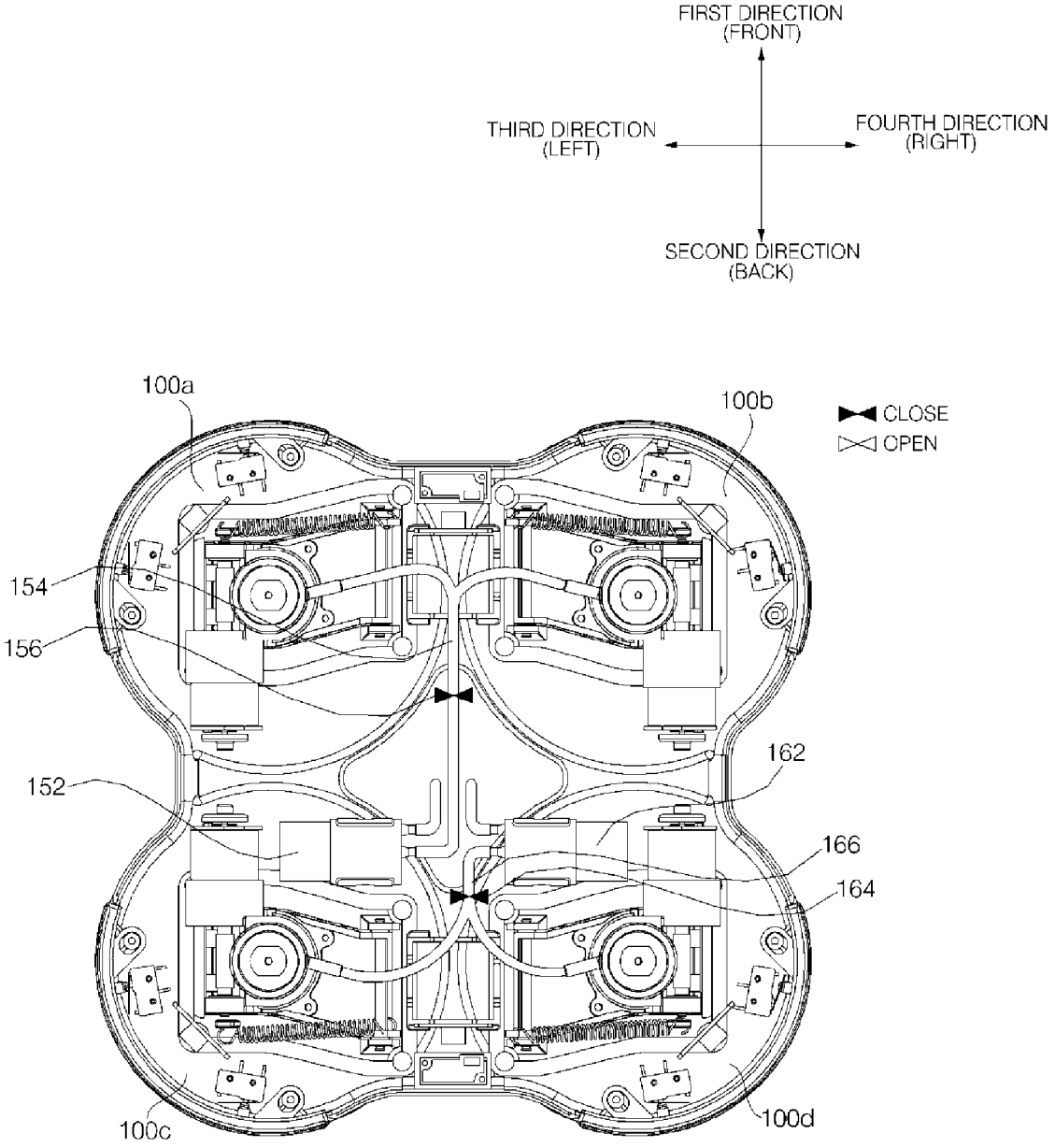
FIG. 17 is a view illustrating driving of the robot cleaner in a dry-cleaning mode according to some embodiments.
Figure 18:
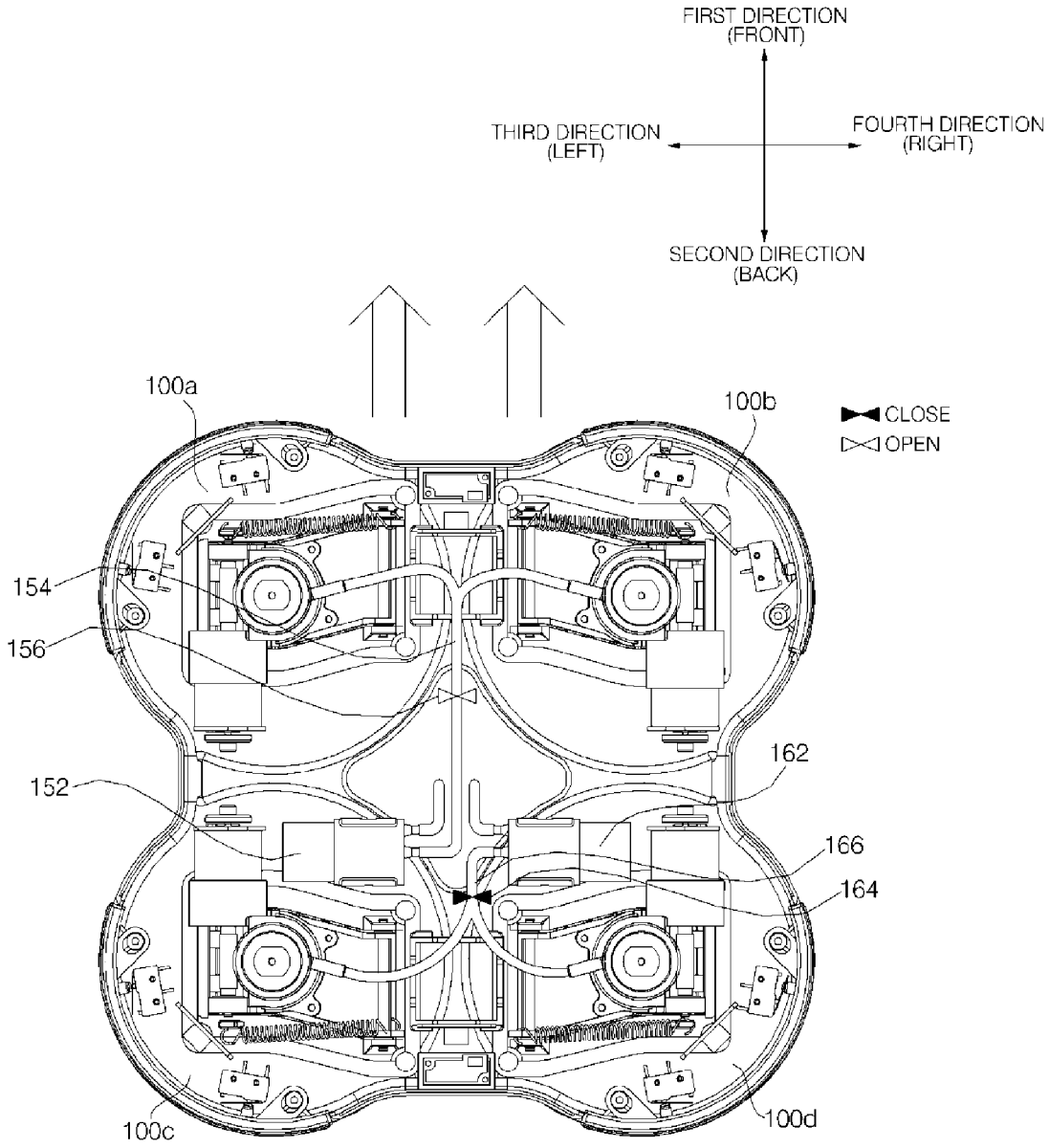
FIG. 18 is another view illustrating driving of the robot cleaner in the dry-cleaning mode according to some embodiments.
Figure 19:
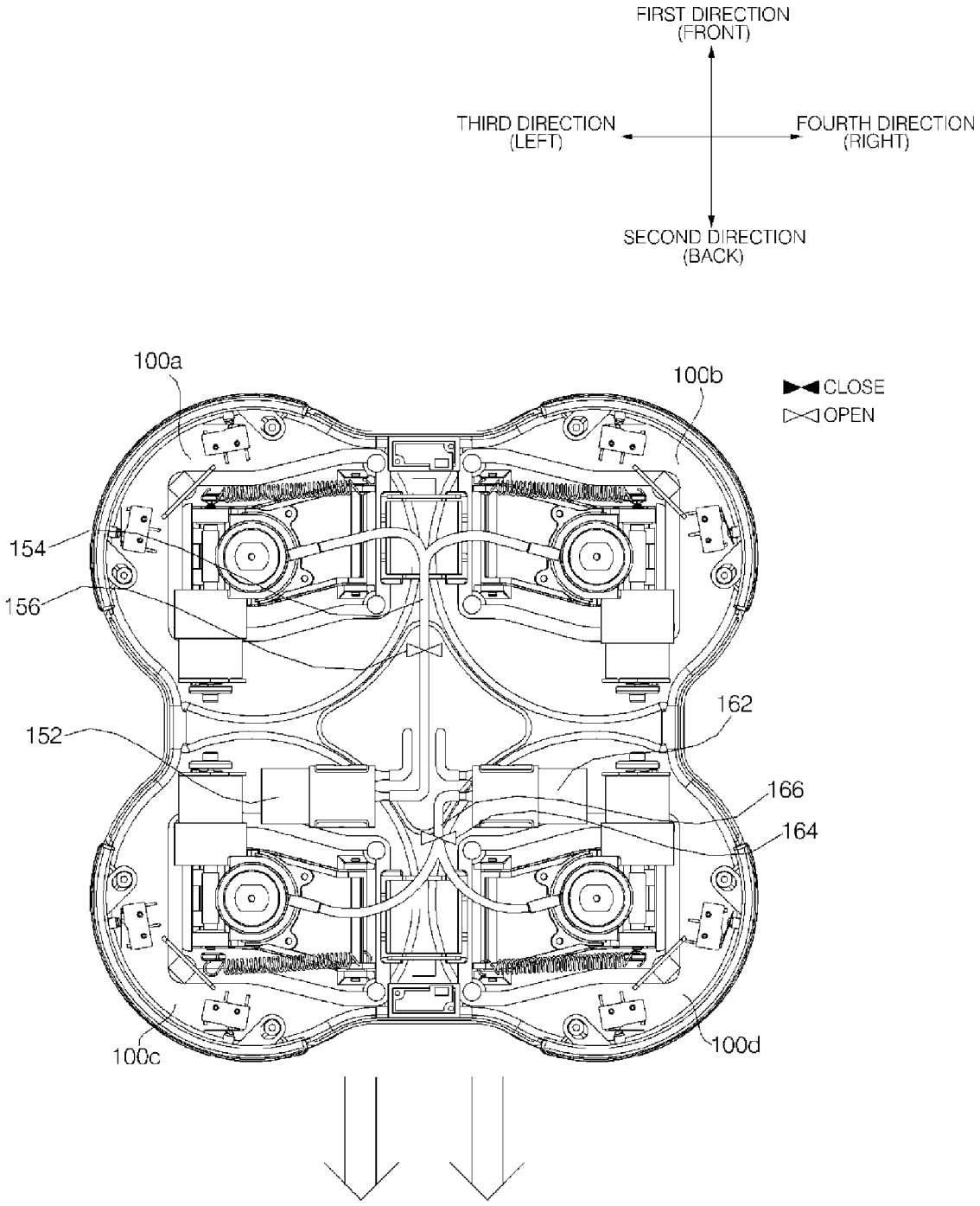
FIG. 19 is another view illustrating driving of the robot cleaner in the dry-cleaning mode according to some embodiments.

FIG. 17 is a view illustrating driving of the robot cleaner in a dry-cleaning mode according to some embodiments. FIG. 18 is another view illustrating driving of the robot cleaner in the dry-cleaning mode according to some embodiments. FIG. 19 is another view illustrating driving of the robot cleaner in the dry-cleaning mode according to some embodiments.

Hereinafter, Referring to FIGS. 17 to 19, a description will be given of controls of the driving assembly, the liquid supply assembly and the cleansing assembly in accordance with a mode of operation for moving of the robot cleaner 10.

In accordance with some embodiments, the robot cleaner 10 moves in a first direction or a second direction. Moving of the robot cleaner 10 in the first direction or the second direction includes a moving forward in the first direction or the second direction and a turning.

Hereinafter, an exemplary first supply assembly 150 is used as a liquid supply assembly which uses water as the first liquid, and an exemplary second supply assembly 160 is used as a cleansing assembly 160 which uses the cleaning liquid as the second liquid. In this case, a description will be given of the operation of the robot cleaner in accordance with a mode of operation in instances where these exemplary embodiments are applied.

In accordance with some embodiments, the robot cleaner (10) includes the first direction spin mop assembly, which is disposed at a lower portion of main body 20 in the first direction, the second direction spin mop assembly, which is disposed at a lower portion of main body 20 in the second direction, a liquid supply assembly 150 configured to supply water to the first direction spin mop assembly, and a cleansing assembly 160 configured to supply a liquid mixed with water and a cleaning liquid to the second direction spin mop assembly.

In accordance with some embodiments, the liquid supply assembly 150 is configured to store water in a first container 32. The liquid supply assembly 150 is connected to the first direction spin mop assembly through a first hose 154. The liquid supply assembly 150 is configured to adjust the supply of water to the first direction spin mop assembly, by opening or closing a first valve 156 which are disposed on the first hose 154.

In accordance with some embodiments, the cleansing assembly 160 is configured to store a cleaning liquid in a second container 34. The cleansing assembly 160 is connected to the second direction spin mop assembly through a second hose 164. The cleansing assembly 160 is configured to adjust the supply of cleaning liquid to the second direction spin mop assembly, by opening or closing a second valve 166 which are disposed on the second hose 164.

The robot cleaner 10 may operate in a dry-cleaning mode in which the spin mop assembly 100 is driven in a dry status, a wet-cleaning mode in which some of a plurality of spin mop assemblies 100 are supplied water and the others of the plurality of spin mop assemblies 100 are driven without the supply of water or in a dry status, or a cleansing mode in which some of the plurality of spin mop assemblies 100 are supplied a liquid mixed with water and a cleaning liquid and the others of the plurality of spin mop assemblies are supplied water.

In instances where the dry-cleaning mode is implemented, the controller 200 of the robot cleaner 10 is configured to cause the first valve 156 and the second valve 166 to be closed. The controller 200 controls moving of the robot cleaner 10 by controlling the driving assembly 130. The robot cleaner 10 moves in the first direction or the second direction, and thus mops the floor.

In instances where the wet-cleaning mode is implemented, the controller 200 of the robot cleaner 10 is configured to cause the first valve 156 to be opened and the second valve 166 to be closed. The controller 200 is configured to cause the robot cleaner 10 to move in the first direction by controlling the driving assembly 130. The robot cleaner 10 moves in the first direction or turns, in a state where the first valve 156 only is opened and water is supplied to the first direction spin mop assembly.

In instances where the wet-cleaning mode is implemented, the robot cleaner 10 moves in the first direction. In this case, the second direction spin mop assembly of the robot cleaner 10 moves on the floor through which the first direction spin mop assembly already passed. Accordingly, the second direction spin mop assembly mops with dry mops the wet floor which the first direction spin mop assembly moped with water. Also, the robot cleaner 10 can perform simultaneously two types of cleaning operations on the floor, a wet mopping and a dry mopping, at one time traveling.

In instances where the cleansing mode is implemented, the controller 200 of the robot cleaner 10 is configured to cause all the first valve 156 and the second valve 166 to be opened. The controller 200 is configured to cause the robot cleaner 10 to move in the second direction by controlling the driving assembly 130. The robot cleaner 10 is configured to open the first valve 156 and the second valve 166. Water is supplied to the first direction spin mop assembly and a cleaning liquid is supplied to the second direction spin mop assembly.

In instances where the cleansing mode is implemented, the robot cleaner 10 moves in the second direction. In this case, the first direction spin mop assembly of the robot cleaner 10 moves on the floor through which the second direction spin mop assembly already passed. Accordingly, the first direction spin mop assembly mops with water the floor which the second direction spin mop assembly mopped with the cleaning liquid. Also, the robot cleaner 10 can perform simultaneously two types of cleaning operations on the floor, a cleansing mopping operation and a wet mopping operation.

It will be understood by those skilled in the art that various changes in form and details may be made therein without departing from the spirit and scope of the invention as defined by the appended claims. Thus, it is intended that the present invention covers the modifications and variations of this invention provided they come within the scope of the appended claims and their equivalents. The scope of the invention is defined not by the detailed description of the invention but by the appended claims, and all differences, variations and modifications within the scope will be construed as being included in the present invention concepts or prospects of the present disclosure.

What is claimed is:

1. A robot cleaner comprising:

a main body;

a plurality of spin mop assemblies disposed at a low portion of the main body and configured to include respective mop pads attached at low portions of the plurality of spin mop assemblies;

at least one driving assembly configured to drive the plurality of spin mop assemblies;

a first supply assembly configured to store a first liquid inside the main body; and a second supply assembly configured to store a second liquid in the main body, wherein the plurality of spin mop assemblies include at least one first spin mop assembly disposed at a front portion of the main body, and at least one second direction spin mop assembly disposed at a back portion of the main body, wherein the first supply assembly includes a first valve to control a supply of the first liquid to the first spin mop assembly, wherein the second supply assembly includes a second valve to control a supply of the second liquid to the second spin mop assembly, wherein the first supply assembly uses water as the first liquid, and the second supply assembly uses a cleaning liquid as the second liquid, wherein the robot cleaner operates in:

a dry-cleaning mode in which the first and the second spin mop assemblies are driven while water and the cleaning liquid are not supplied;

a wet-cleaning mode in which the first spin mop assembly is driven while supplied with water and the second spin mop assembly is driven while not supplied with the cleaning liquid; and a cleansing mode in which the first spin mop assembly is driven while supplied with water, and the second spin mop assembly is driven while supplied with the cleaning liquid, and wherein the robot cleaner further comprises a controller configured to control operation of the driving assembly and to selectively open and close the first and second valves in accordance with whether the robot cleaner is operating in the dry-cleaning mode, the wet-cleaning mode, or the cleansing mode.

2. The robot cleaner according to claim 1, wherein at least two of the spin mop assemblies are disposed on a left portion of main body and at least two spin mop assemblies are disposed on a right portion of the main body, wherein the at least one driving assembly is configured to drive the at least two spin mop assemblies disposed on the left portion of main body in a first rotational direction and at a first rotational speed, and to drive the at least two spin mop assemblies disposed on the right portion of main body in a second rotational direction and at a second rotational speed.

3. The robot cleaner according to claim 1, further comprising a first container configured to store the first liquid and a second container configured to store the second liquid.

4. The robot cleaner according to claim 1, wherein the first supply assembly includes:

a first container configured to store the first liquid;

a first pump for supplying the first liquid stored in the first container to the first spin mop assembly; and a first hose forming a channel for guiding a flow of the first liquid from the first container to the first spin mop assembly, wherein the first valve is disposed on the first hose and configured to adjust the flow of the first liquid.

5. The robot cleaner according to claim 1, wherein the second supply assembly includes:

a second container configured to store the second liquid;

a second pump for supplying the second liquid stored in the second container to the second spin mop assembly; and a second hose forming a channel for guiding a flow of the second liquid from the second container to the second spin mop assembly, wherein the second valve is disposed on the second hose and configured to adjust the flow of the second liquid.

6. The robot cleaner according to claim 1, further comprising a plurality of bumper assemblies disposed on the main body, and for detecting or reducing an external impact to the main body.

7. The robot cleaner according to claim 6, wherein each of the bumper assemblies include two impact detection sensors, which are disposed to detect impacts in respective directions which are vertically separated from each other.

8. The robot cleaner according to claim 6, wherein each of the plurality of bumper assemblies includes a bumper that extends to enclose a portion of a side region of a corresponding one the plurality of spin mop assemblies.

9. The robot cleaner according to claim 8, wherein each of the bumper assemblies includes:

an impact detection sensor to detect a movement of the bumper, a pressure sensor to detect a force associated with the movement of the bumper, and a movement guider member to guide the movement of the bumper.

10. The robot cleaner according to claim 1, wherein the controller further manages at least one of an actuating of the driving assembly or an opening or closing of the first valve and the second valve in accordance with a movement of the robot cleaner.

11. The robot cleaner according to claim 1, wherein, in the dry-cleaning mode, the controller controls the first valve and the second valve to close, and controls the driving assembly such that the robot cleaner moves in a first direction associated with the first spin mop assembly or in a second direction associated with the second spin mop assembly.

12. The robot cleaner according to claim 1, wherein, in the wet-cleaning mode, the controller controls the first valve to open and the second valve to close, and the driving assembly such that the robot cleaner moves in a direction associated with the first spin mop assembly.

13. The robot cleaner according to claim 1, wherein, in the cleansing mode, the controller controls the first valve and the second valve to open, and the driving assembly such that the robot cleaner moves in a direction associated with the second spin mop assembly.

14. The robot cleaner according to claim 1, wherein the at least one driving assembly includes a plurality of driving assemblies that each drive a corresponding one of the plurality of spin mop assemblies, wherein each of the plurality of driving assemblies includes:

a motor having a drive shaft; and gears to transfer power from the motor to a rotation shaft in the corresponding one of the plurality of spin mop assemblies.

15. The robot cleaner according to claim 14, wherein the gears include a worm gear that engages the drive shaft, and a worm that engages the worm gear.

16. The robot cleaner according to claim 1, wherein the at least one first spin mop assembly includes two spin mop assemblies, and wherein the robot cleaner further comprises a charger for charging the robot cleaner, and the charger is positioned to extend between rotational shafts of the two spin mop assemblies of the at least one first spin mop assembly.

17. The robot cleaner according to claim 1, wherein the at least one second spin mop assembly includes two spin mop assemblies, and wherein the controller is positioned to extend between rotational shafts of the two spin mop assemblies of the at least one second spin mop assembly.

* * * * *